US011143983B2

(12) United States Patent
Choi et al.

(10) Patent No.: US 11,143,983 B2
(45) Date of Patent: Oct. 12, 2021

(54) TONER SUPPLYING APPARATUS AND IMAGE FORMING APPARATUS HAVING THE SAME

(71) Applicant: Hewlett-Packard Development Company, L.P., Spring, TX (US)

(72) Inventors: Jae Won Choi, Suwon-si (KR); Han Jun Lee, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/966,334

(22) PCT Filed: Oct. 1, 2018

(86) PCT No.: PCT/KR2018/011614
§ 371 (c)(1),
(2) Date: Jul. 30, 2020

(87) PCT Pub. No.: WO2019/151605
PCT Pub. Date: Aug. 8, 2019

(65) Prior Publication Data

US 2020/0371451 A1 Nov. 26, 2020

(30) Foreign Application Priority Data

Jan. 31, 2018 (KR) ..... 10-2018-0012114

(51) Int. Cl.
*G03G 15/08* (2006.01)

(52) U.S. Cl.
CPC ..... *G03G 15/0856* (2013.01); *G03G 15/0872* (2013.01)

(58) Field of Classification Search
CPC ..... G03G 15/0856; G03G 15/0872
See application file for complete search history.

(56) References Cited

U.S. PATENT DOCUMENTS

2002/0089274 A1 7/2002 Liang et al.
2010/0272452 A1 10/2010 Tsukijima
2013/0336675 A1* 12/2013 Akutsu ..... G03G 21/1676 399/119
2017/0102637 A1 4/2017 Seto

FOREIGN PATENT DOCUMENTS

KR 1020020070542 9/2002
KR 1020120064374 6/2016

* cited by examiner

*Primary Examiner* — Victor Verbitsky
(74) *Attorney, Agent, or Firm* — Staas & Halsey LLP

(57) ABSTRACT

A toner supplying apparatus used in an image forming apparatus is provided. The toner supply apparatus includes a plurality of toner containers, a plurality of fixing members, an operating member, and a driving force. Each of the plurality of toner containers includes a fixing recess. The plurality of fixing members are to be selectively coupled to the fixing recesses of the plurality of toner containers. The operating member is to slide with respect to the plurality of toner containers, and to operate at least one of the plurality of fixing members to separate the operated fixing members from the coupled fixing recess. The driving device is to move the operating member.

15 Claims, 19 Drawing Sheets

【Figure 1】
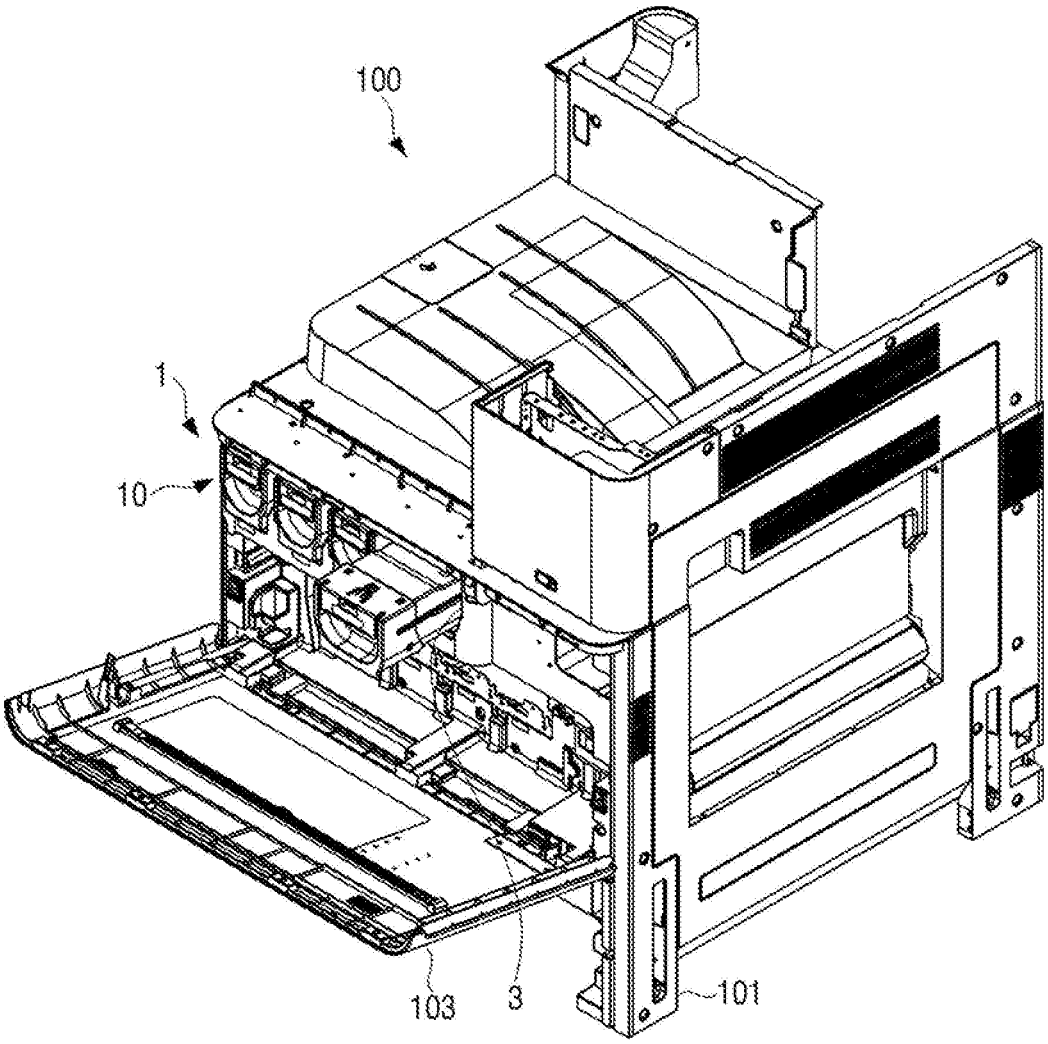

【Figure 2】
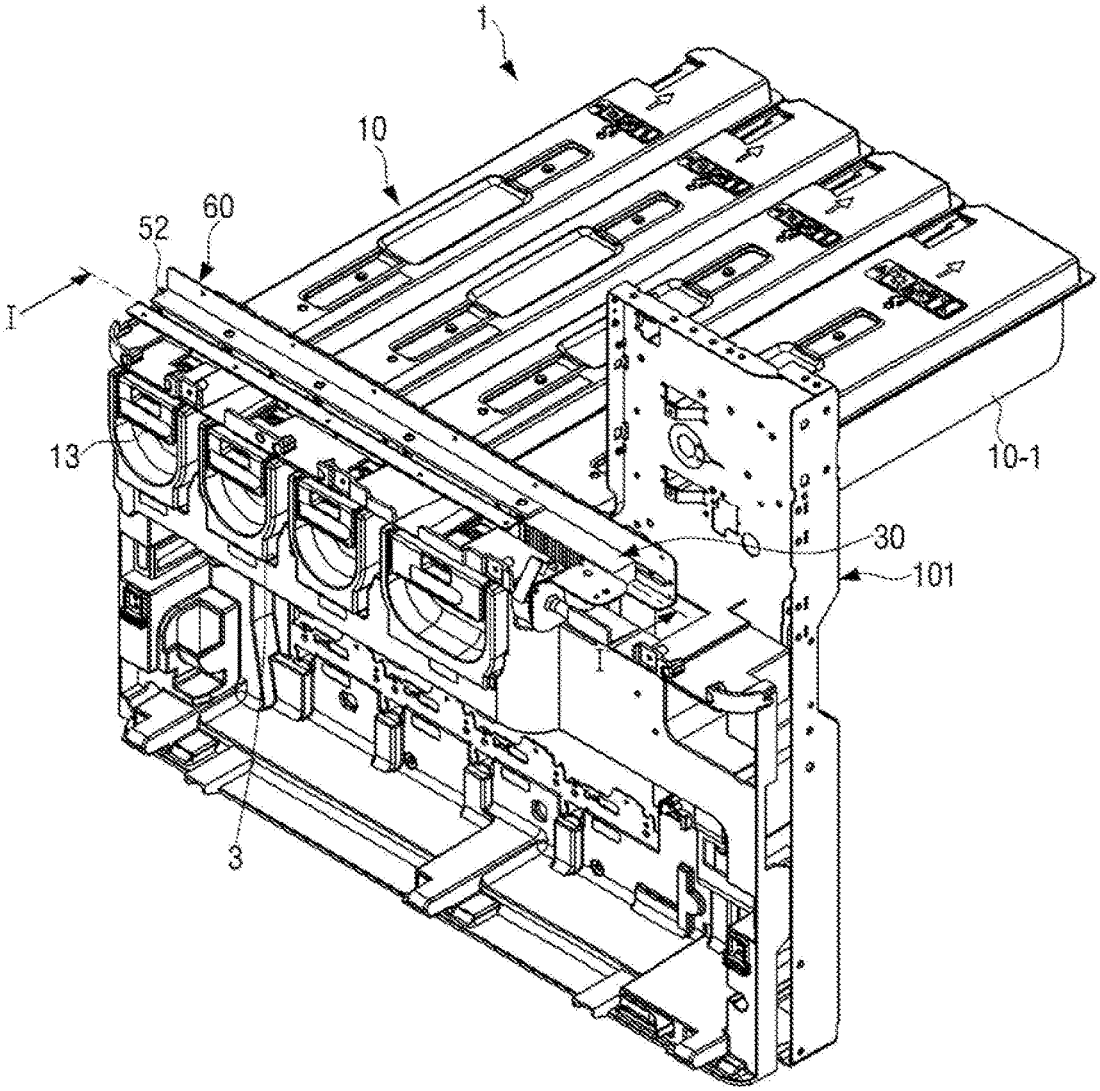

【Figure 3】
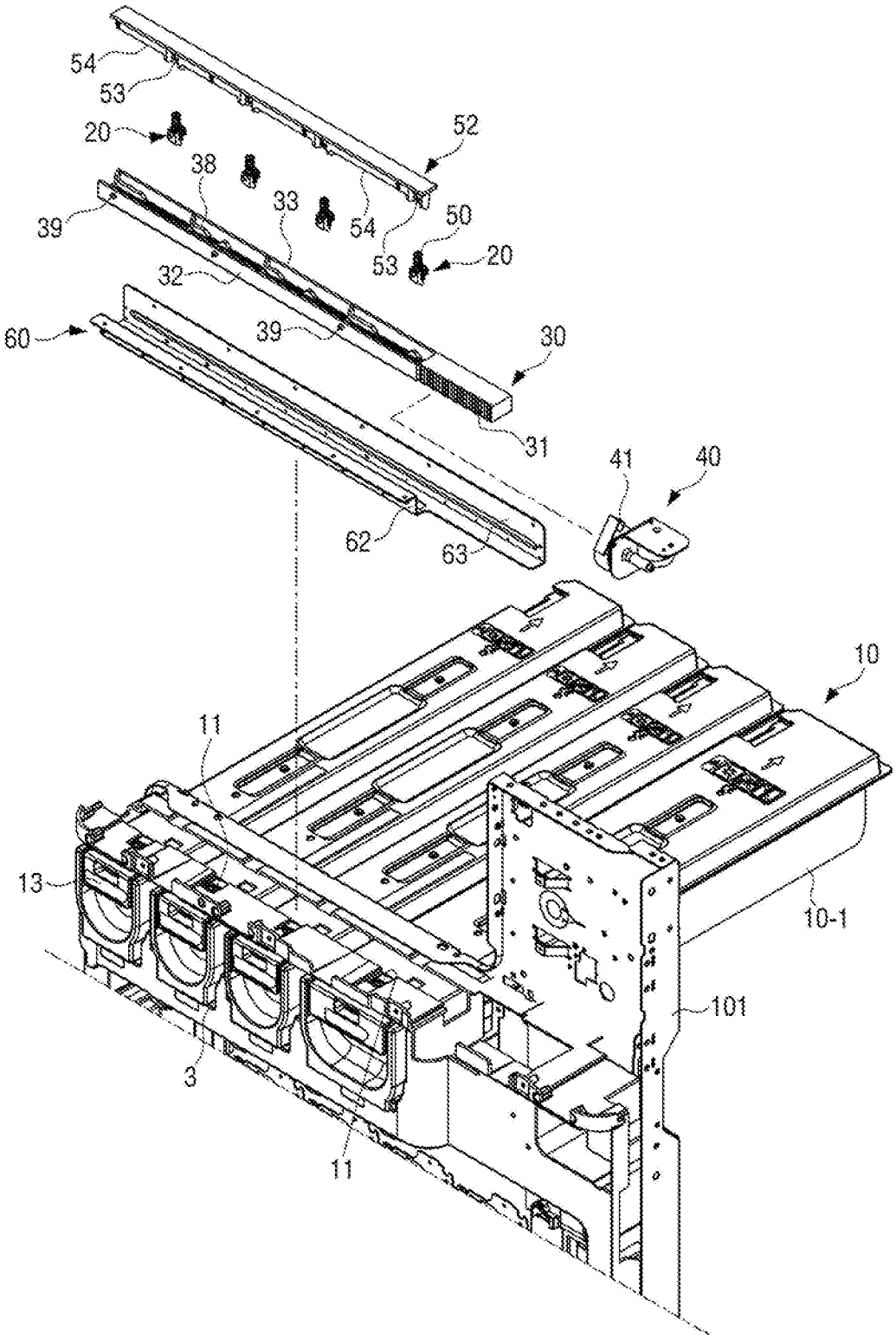

【Figure 4】
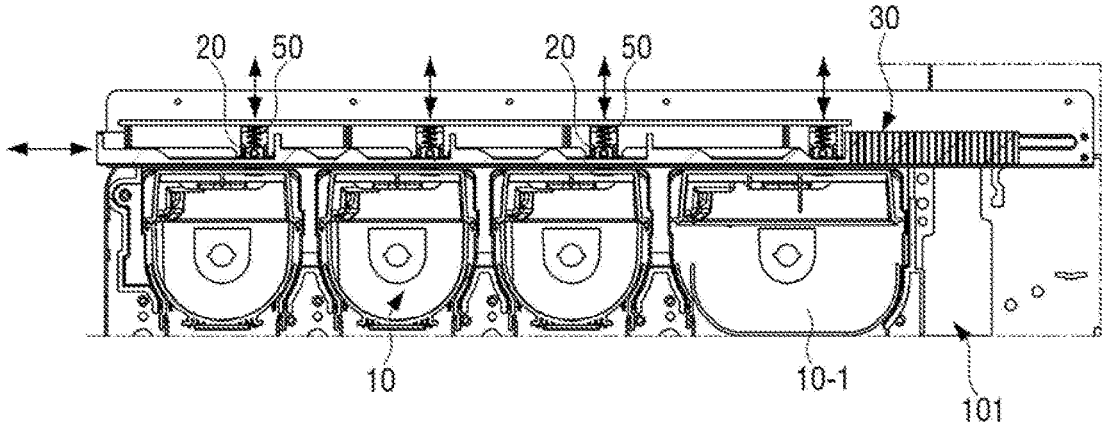
【Figure 5】
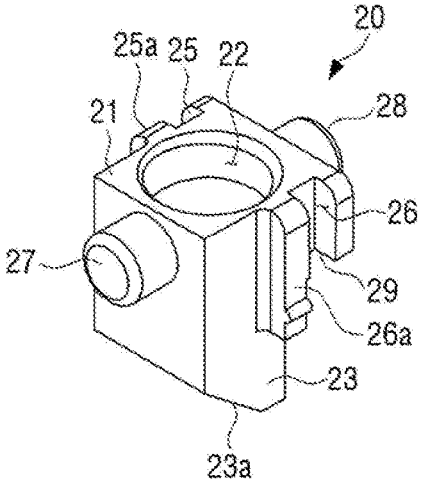

【Figure 6】
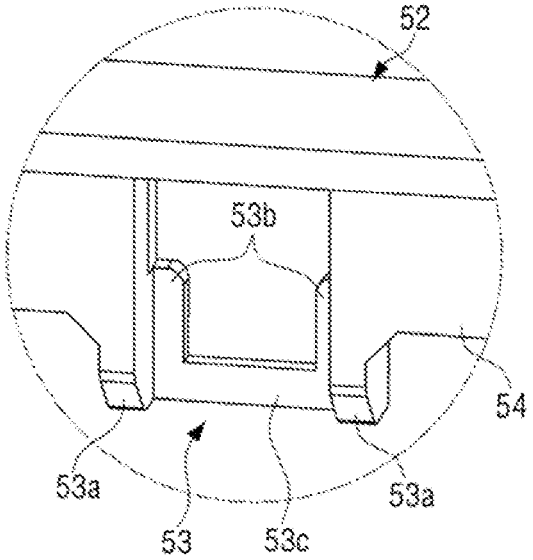
【Figure 7】
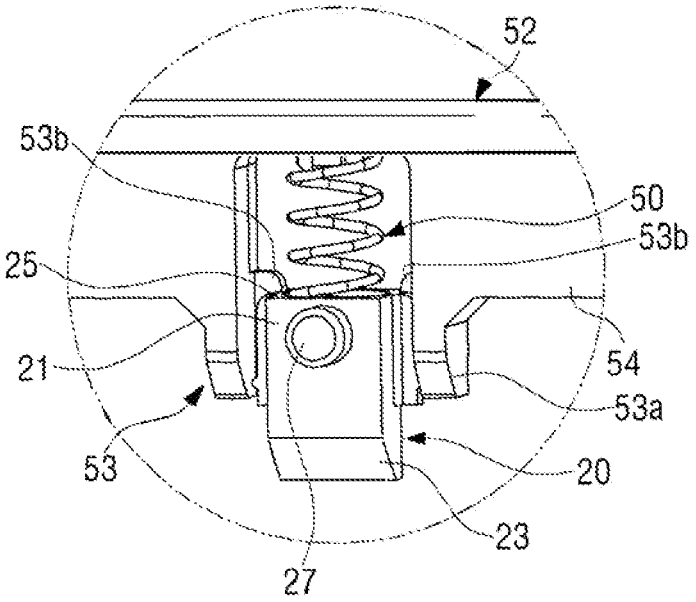

【Figure 8】
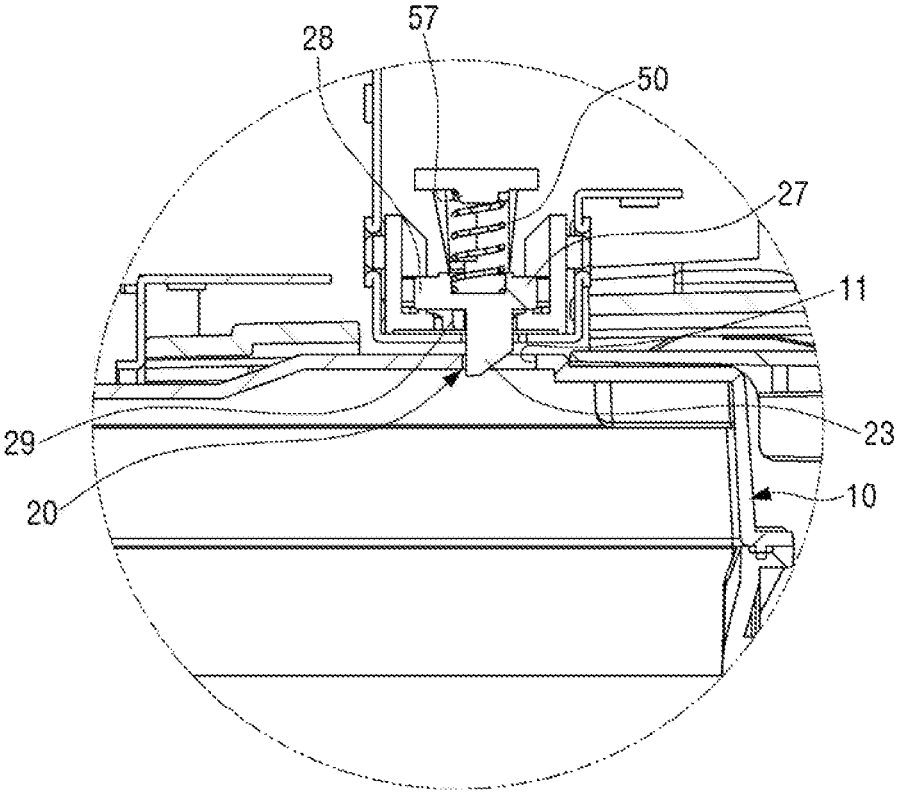

【Figure 9】
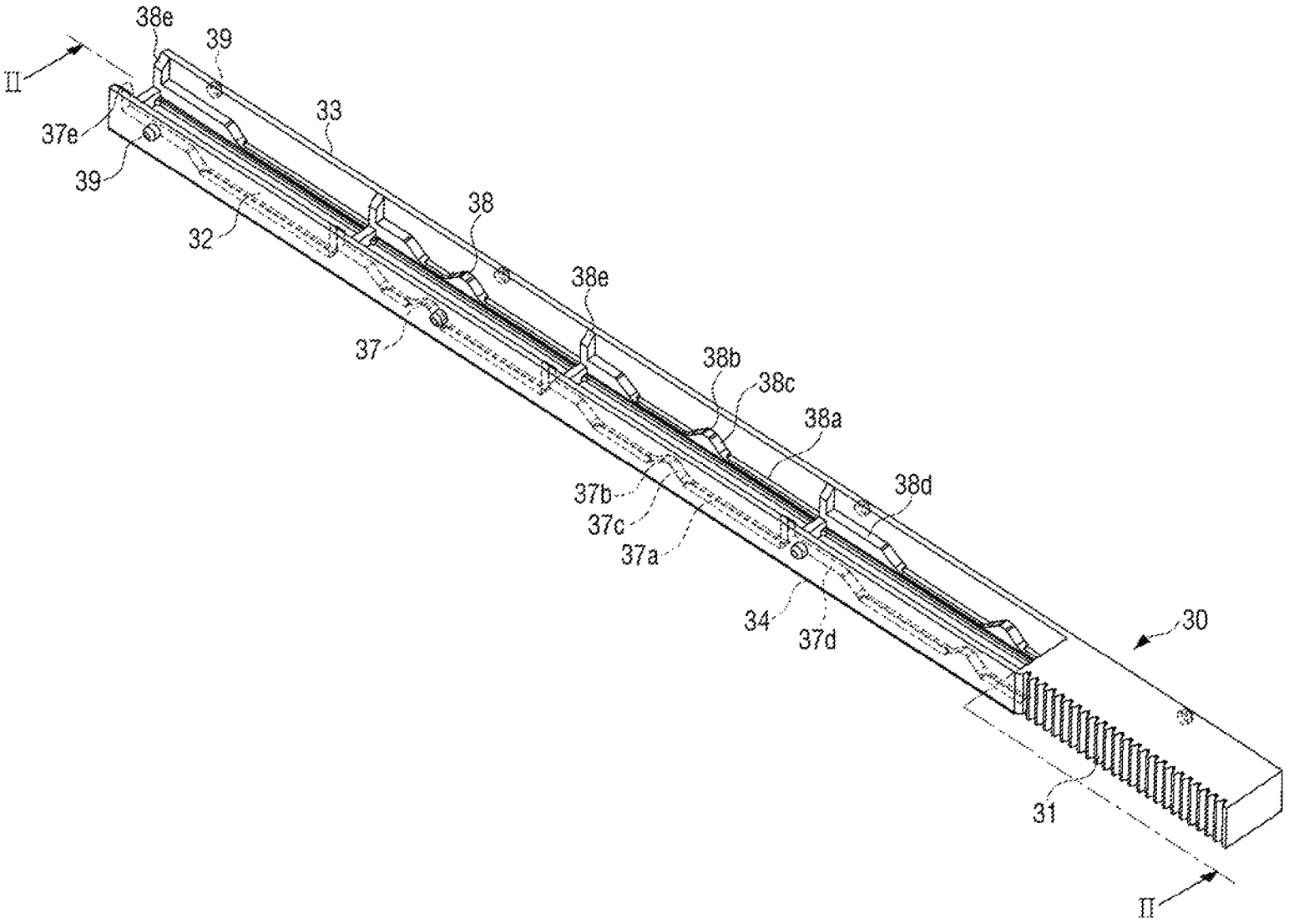

【Figure 10】
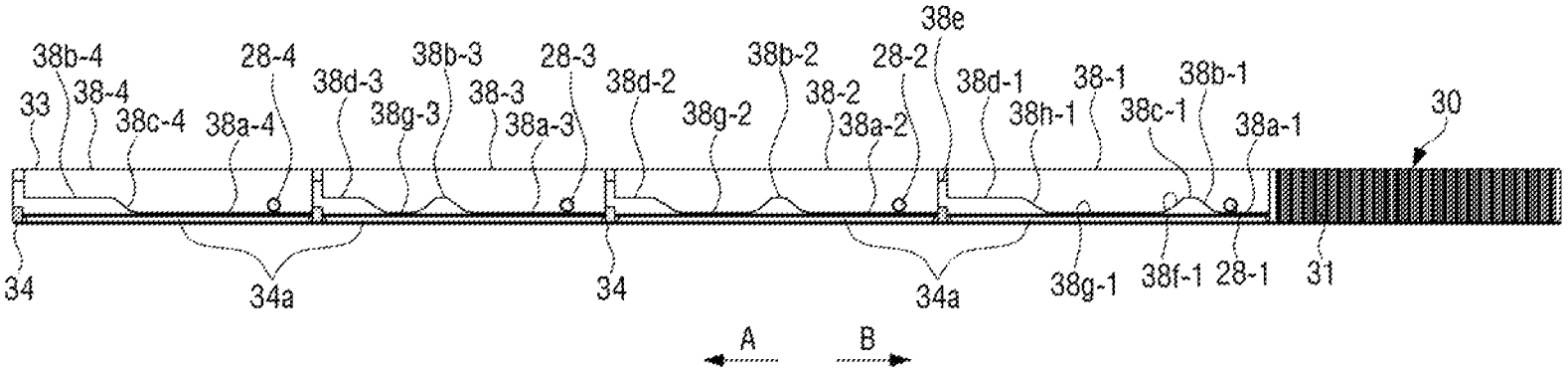

【Figure 11A】
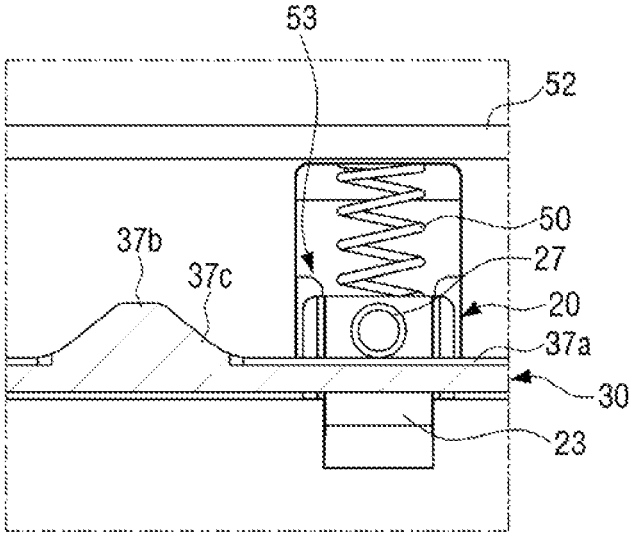
【Figure 11B】
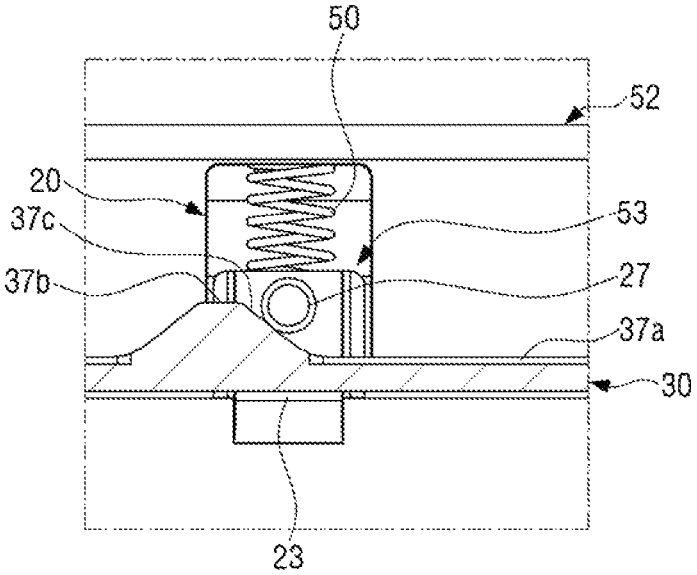

【Figure 11C】
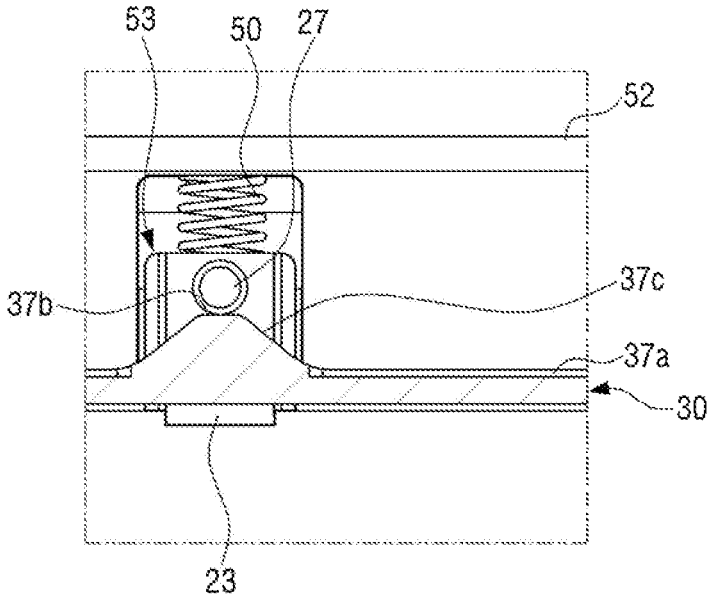
【Figure 12】
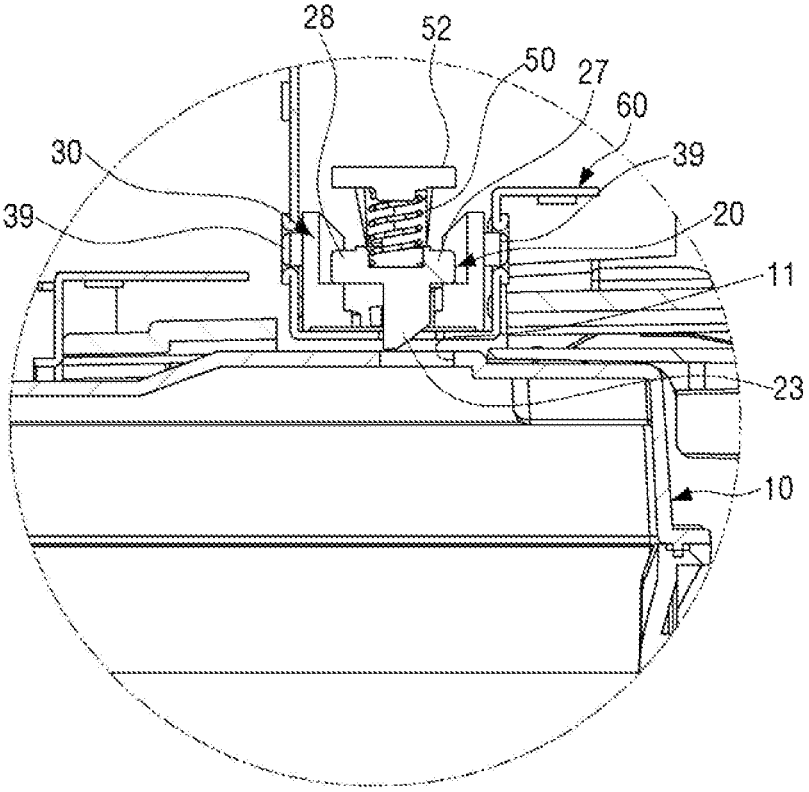

【Figure 13】
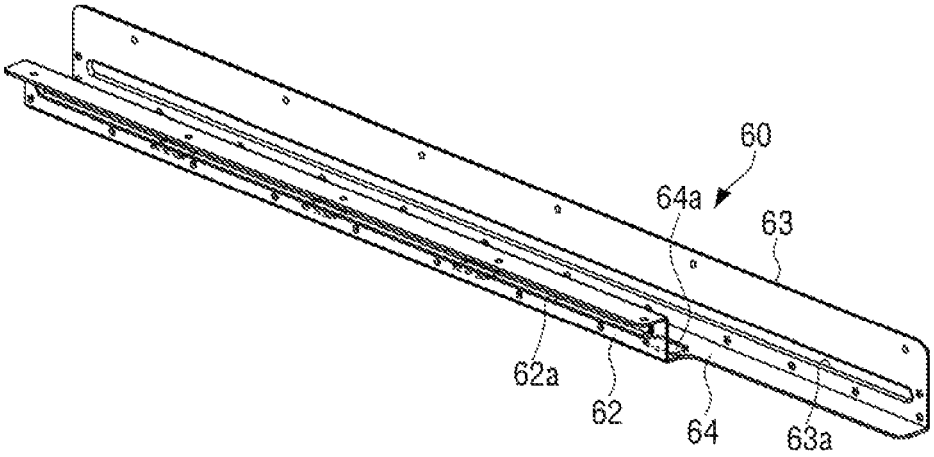
【Figure 14】
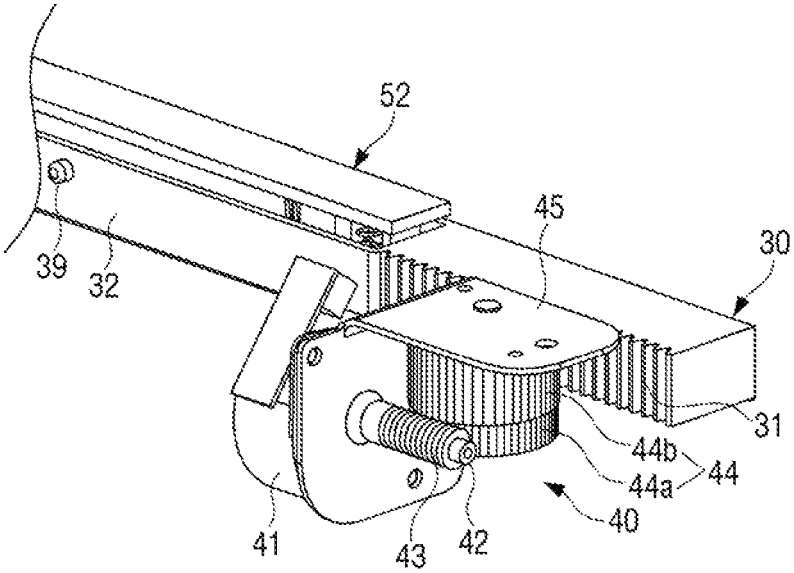

【Figure 15】
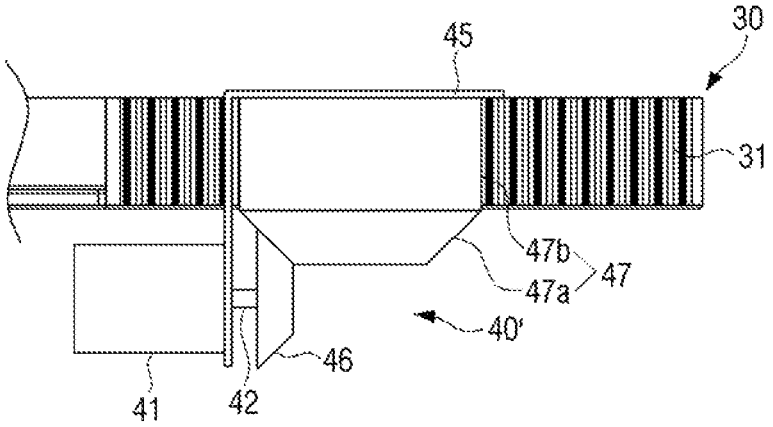

【Figure 16】
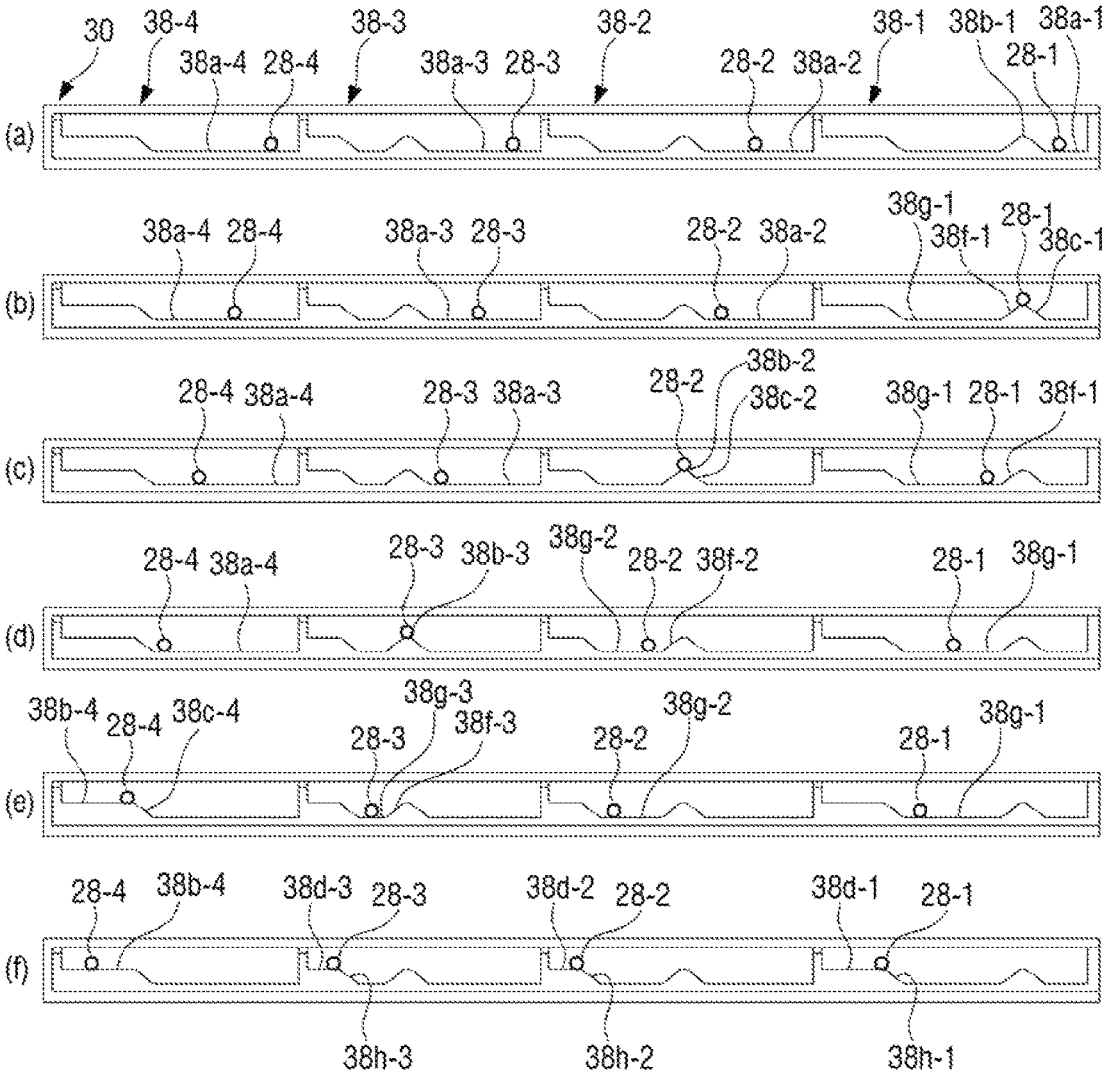

【Figure 17】
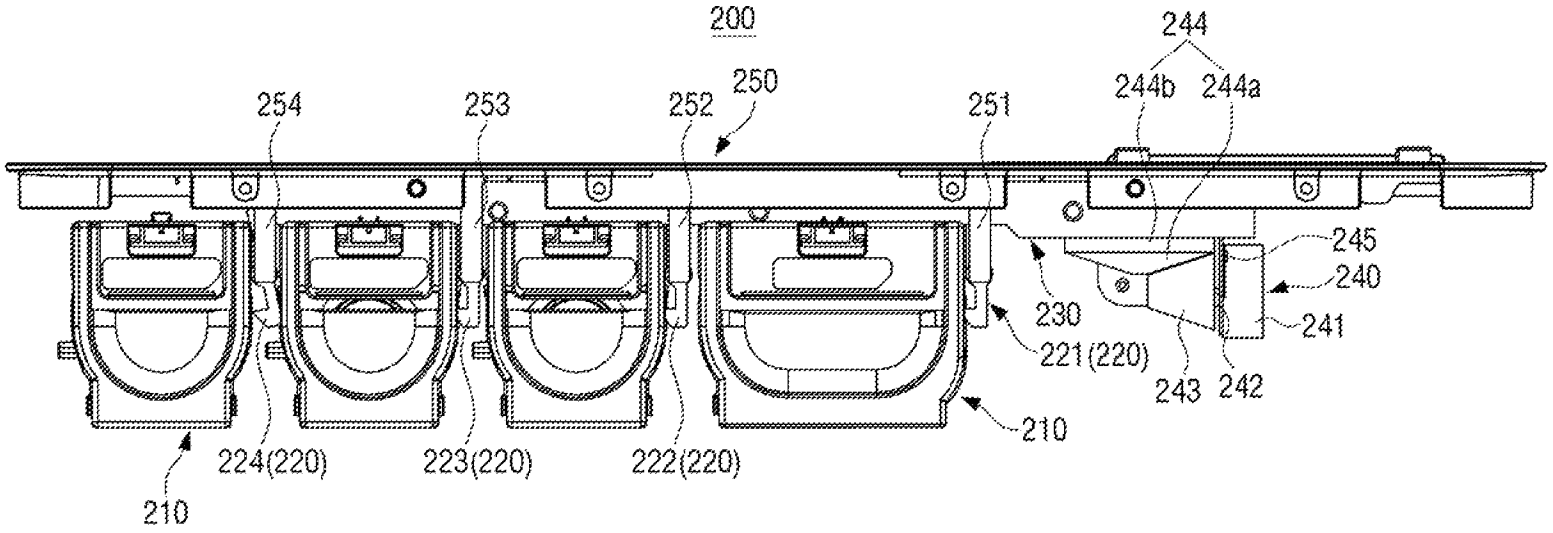

【Figure 18】
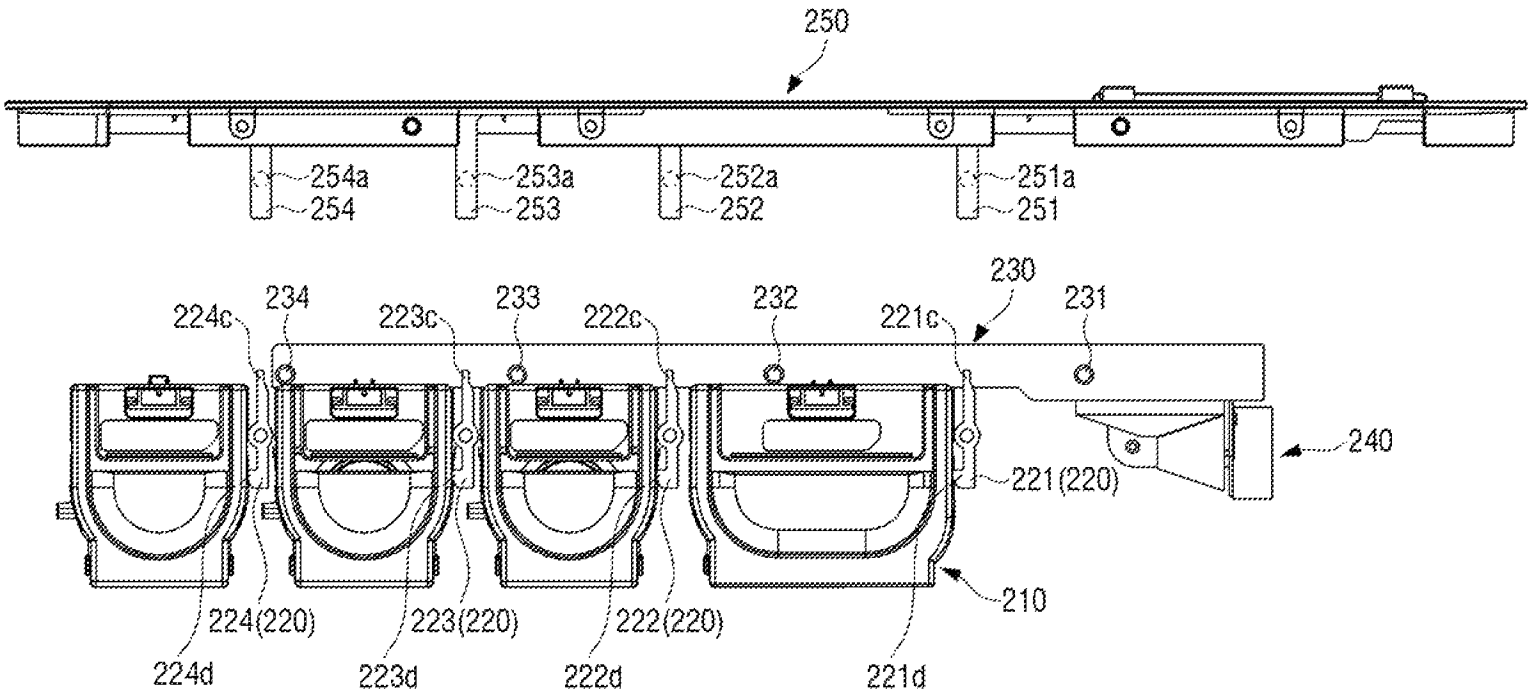

【Figure 19】
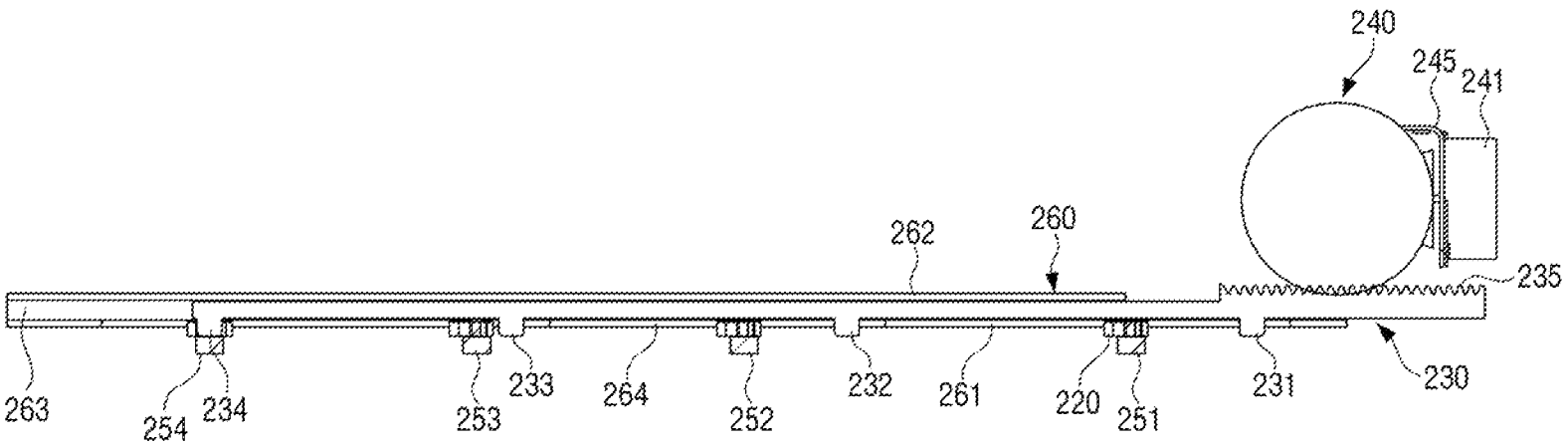

【Figure 20】
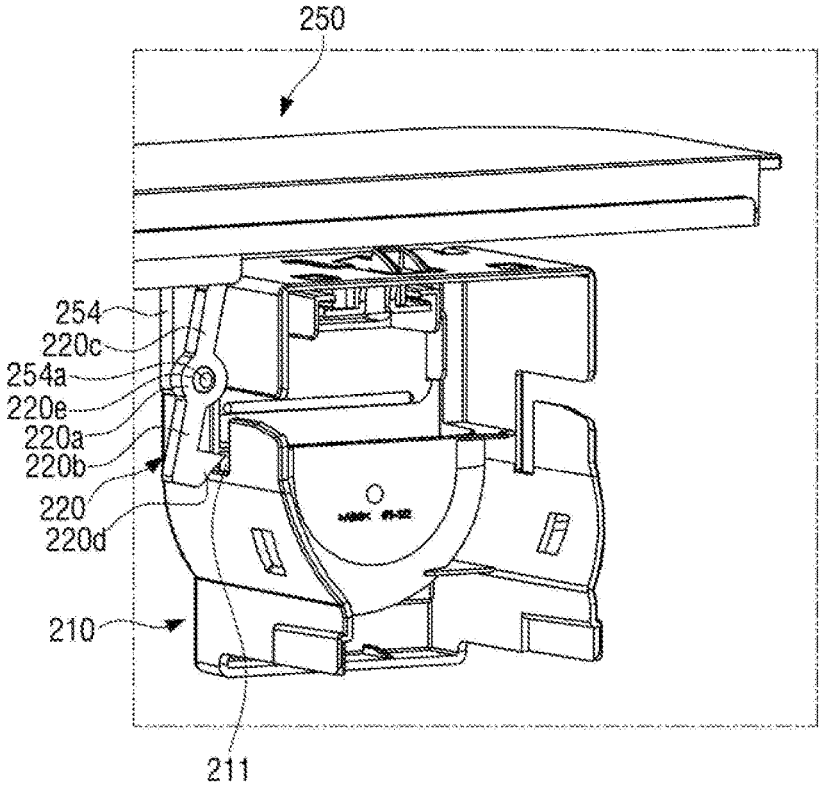
【Figure 21A】
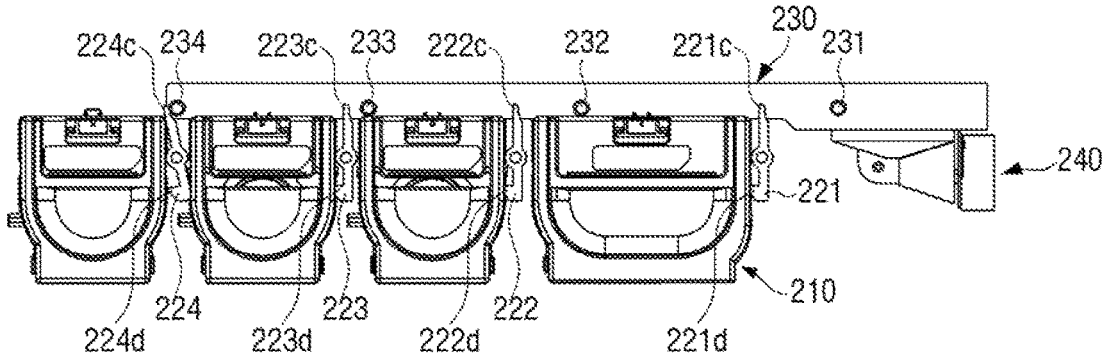

【Figure 21B】
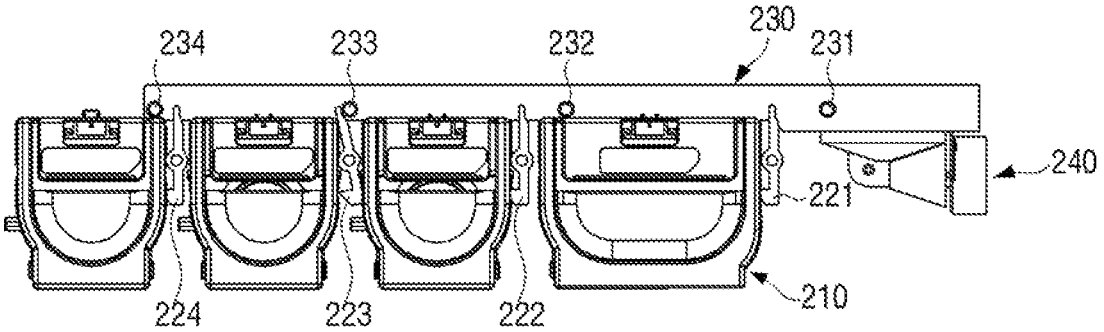
【Figure 21C】
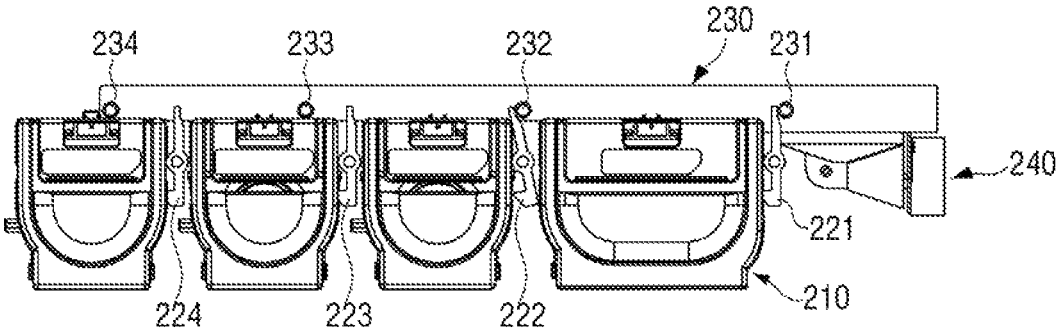
【Figure 21D】
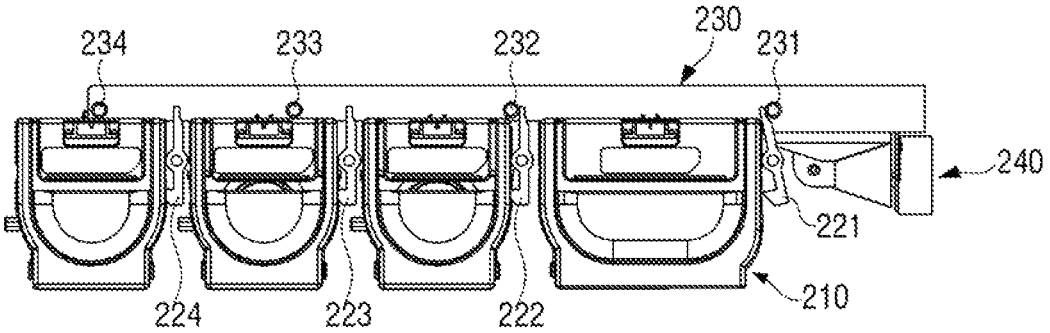

【Figure 22】
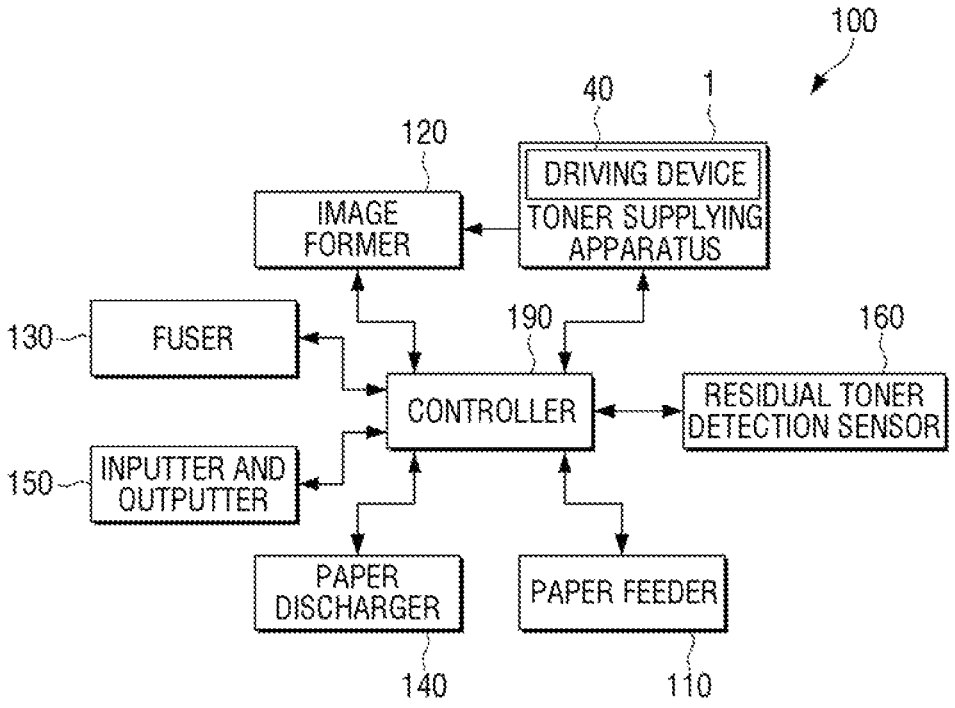

TONER SUPPLYING APPARATUS AND IMAGE FORMING APPARATUS HAVING THE SAME

CROSS REFERENCE TO RELATED APPLICATIONS

This application is a U.S. National Stage Application which claims the benefit under 35 U.S.C. § 371 of International Patent Application No. PCT/KR2018/011614 filed on Oct. 1, 2018, which claims foreign priority benefit under 35 U.S.C. § 119 of Korean Patent Application No. 10-2018-0012114 filed on Jan. 31, 2018, in the Korean Intellectual Property Office, the contents of all of which are incorporated herein by reference.

BACKGROUND ART

In general, an image forming apparatus forming an image by using toner, such as a printer, a multi-function peripheral (MFP), a facsimile machine, or the like, is provided with a toner container containing a predetermined amount of toner. Such an image forming apparatus is to replace the toner container after toner in the toner container is completely consumed.

However, some users may replace the toner container having toner remaining therein. In particular, in the case of a color image forming apparatus using a plurality of toner containers, users may replace toner containers that do not need to be replaced and have toner remaining therein due to user's misrecognition.

When the toner container is replaced before toner stored therein is not completely used, a maintenance cost of the image forming apparatus increases. Therefore, toner supplying apparatuses that can prevent a toner container from being replaced until toner is completely used are being developed.

DISCLOSURE

Description of Drawings

FIG. 1 is a perspective view illustrating an image forming apparatus according to an example;

FIG. 2 is a perspective view illustrating a toner supplying apparatus according to an example;

FIG. 3 is an exploded perspective view illustrating the toner supplying apparatus according to an example;

FIG. 4 is a cross-sectional view taken on line I-I of the toner supplying apparatus of FIG. 2;

FIG. 5 is a perspective view illustrating a fixing member of the toner supplying apparatus according to an example;

FIG. 6 is a partial perspective view illustrating a guide portion of a guide member of the toner supplying apparatus according to an example;

FIG. 7 is a partial view illustrating a state in which the fixing member of the toner supplying apparatus is coupled to the guide portion according to an example;

FIG. 8 is a partial cross-sectional view illustrating a state in which the fixing member of the toner supplying apparatus is inserted into a fixing recess of a toner container according to an example;

FIG. 9 is a perspective view illustrating an operating member of the toner supplying apparatus according to an example;

FIG. 10 is a cross-sectional view taken on line II-II of the operating member of FIG. 9;

FIGS. 11A to 11C are views to illustrate an operation of the fixing member by the operating member of the tonner supplying apparatus according to an example;

FIG. 12 is a partial cross-sectional view illustrating a state in which the fixing member of the toner supplying apparatus is released from the fixing recess of the toner container according to an example;

FIG. 13 is a perspective view illustrating a guide bracket of the toner supplying apparatus according to an example;

FIG. 14 is a perspective view illustrating a driving device of the toner supplying apparatus according to an example;

FIG. 15 is a view illustrating another example of the driving device of the toner supplying apparatus according to an example;

FIGS. 16A to 16F are views to illustrate an operation of the toner supplying apparatus according to an example;

FIG. 17 is a view illustrating a toner supplying apparatus according to anther example;

FIG. 18 is a view illustrating a state in which a support bracket is separated from the toner supplying apparatus of FIG. 17;

FIG. 19 is a view illustrating arrangement of a plurality of fixing members and an operating member in the toner supplying apparatus of FIG. 17;

FIG. 20 is a partial perspective view illustrating a fixing recess and a fixing member of a toner container of the toner supplying apparatus of FIG. 17;

FIGS. 21A to 21D are views to illustrate an operation of the toner supplying apparatus of FIG. 17; and FIG. 22 is a function block diagram illustrating an image forming apparatus including a toner supplying apparatus according to an example.

MODE FOR INVENTION

Hereinafter, a toner supplying apparatus and an image forming apparatus having the same according to examples will be described in detail with reference to the accompanying drawings.

Examples described hereinafter are examples for easy understanding of the present disclosure, and it should be understood that various changes can be made to examples described herein and the present disclosure can be embodied in different forms. In addition, in the following description, detailed descriptions of well-known functions or configurations will be omitted since they would unnecessarily obscure the subject matters of the present disclosure. In addition, it should be noted that the drawings as attached are just for easy understanding of the present disclosure, and are not illustrated as really scaled, and dimensions of some elements may be exaggerated.

FIG. 1 is a perspective view illustrating an image forming apparatus according to an example. FIG. 2 is a perspective view illustrating a toner supplying apparatus according to an example. FIG. 3 is an exploded perspective view illustrating the toner supplying apparatus according to an example. FIG. 4 is a cross-sectional view taken on line I-I of the toner supplying apparatus of FIG. 2.

FIG. 1 is a perspective view illustrating an example of an image forming apparatus 100 in which a toner supplying apparatus is installed according to an example. FIG. 1 illustrates a state in which a fixing member 20 for fixing a single toner container 10 is released by an operation of the toner supplying apparatus 1, and a portion of the single toner container 10 is exposed to the outside. The toner supplying apparatus 1 is installed on a side surface of the image forming apparatus 100 to be able to mount or dismount the toner container 10.

Referring to FIGS. 2 to 4, the toner supplying apparatus 1 according to an example may include a plurality of toner containers 10, a plurality of fixing members 20, an operating member 30, and a driving device 40.

The plurality of toner containers 10 may be installed in a plurality of toner container mounting units 3 provided in a frame 101 of the image forming apparatus 100. The plurality of toner containers 10 are installed to have their respective front surfaces exposed to the outside of the image forming apparatus 100. As shown in FIG. 1, a door 103 may be provided on the image forming apparatus 100 to cover the entire front surfaces of the plurality of toner containers 10.

Each of the plurality of toner containers 10 may have a fixing recess 11 formed on an upper surface thereof to allow the fixing member 20 to be inserted thereinto. When the fixing member 20 is inserted into the fixing recess 10 of the toner container 10, the toner container 10 is not released from the toner container mounting unit 3. In addition, a handle 13 may be provided on the front surface of the toner container 10. Accordingly, a user may mount or dismount the toner container 10 to or from the toner container mounting unit 3 of the frame 101, while holding the handle 13.

The toner supplying apparatus 1 according to the present example includes four toner containers 10. Accordingly, four toner container mounting units 3 are provided in the frame 101. The four toner containers 10 may contain toner of black, magenta, cyan, and yellow, respectively. In this case, the black toner container 10-1 may be designed to contain a larger amount of toner than the other three toner containers 10. Although the supply supplying apparatus 1 includes the four toner containers 10 in the present example, the present disclosure is not limited thereto. The present disclosure can be applied to a toner supplying apparatus including two or more toner containers 10.

The plurality of fixing members 20 may be formed to be selectively connected to the fixing recesses 11 of the plurality of toner containers 10, respectively. The plurality of fixing members 20 may correspond to the plurality of toner containers 10 in number. That is, one fixing member 20 is provided for one toner container 10.

As shown in FIG. 4, the plurality of fixing members 20 may be installed on upper sides of the plurality of toner containers 10, and may be provided to be movable in a vertical direction. Since the plurality of fixing members 20 may be formed the same, one fixing member 20 will be described in detail hereinbelow with reference to FIG. 4.

FIG. 5 is a perspective view illustrating the fixing member of the toner supplying apparatus according to an example.

Referring to FIG. 5, the fixing member 20 may include a body portion 21, an insertion portion 23, one pair of guide protrusions 27, 28, and one pair of guide recesses 25, 26.

The body portion 21 is formed in a substantially cuboid shape, and has a pressing member receiving portion 22 formed on an upper surface thereof to allow a pressing member 50 to be installed therein. The body portion 21 may have the insertion portion 23 formed on a lower surface thereof to be inserted into the fixing recess 11 of the toner container 10. The insertion portion 23 may extend perpendicular to the body portion 21, and may have an inclined surface 23*a* formed on one side surface thereof. Accordingly, the insertion portion 23, the body portion 21, and the pressing member 50 are substantially collinear.

The one pair of guide protrusions 27, 28 are provided on a front surface and a rear surface of the body portion 21 on the same straight line. That is, the first guide protrusion 27 is provided on the front surface of the body portion 21, and the second guide protrusion 28 is provided on the rear surface of the body portion 21. The one pair of guide protrusions, that is, the first guide protrusion 27 and the second guide protrusion 28, are formed to be collinear. The first and second guide protrusions 27, 28 may be formed in a cylindrical shape.

In addition, a locking projection 29 may be formed under the second guide protrusion 28 provided on the rear surface of the body portion 21. The locking projection 29 restricts a downward movement of the fixing member 20 by the pressing member 50 by a predetermined distance.

The one pair of guide recesses 25, 26 are formed on both side surfaces of the body portion 21, that is, on the left side surface and the right side surface. That is, the first guide recess 25 is provided on the left side surface of the body portion 21, and the second guide recess 26 is provided on the right side surface of the body portion 21. The one pair of guide recesses, that is, the first guide recess 25 and the second guide recess 26, are formed to guide a guide portion 53 of a guide member 52, which will be described below, to be inserted thereinto. In the present example, the first and second guide recesses 25, 26 are formed by two guide ribs 25*a*, 26*a* protruding from the left side surface and the right side surface of the body portion 21, respectively, and spaced apart from each other by a predetermined distance. However, the shapes of the guide recesses 25, 26 are limited thereto. The guide recesses 25, 26 may be formed by digging into the left side surface and the right side surface of the body portion 21 in the vertical direction. When the guide portion 53 of the guide member 52 is inserted into the one pair of guide recesses 25, 26, the fixing member 20 may move up and down along the guide portion 53.

The guide member 52 is installed on the upper sides of the plurality of fixing members 20, and is provided with the plurality of guide portions 53 to guide the up and down movements of the plurality of fixing members 20. The plurality of guide portions 53 may correspond to the plurality of fixing members 20 in number. For example, when four fixing members 20 are provided as in the present example, the guide member 52 is provided with four guide portions 53.

Referring to FIG. 3, the guide member 52 is formed of a long bar type plate, and is provided with the plurality of guide portions 53 formed on the lower surface thereof at predetermined intervals. Support walls 54 are provided between the plurality of guide portions 53 to be perpendicular to the lower surface of the guide member 52. The plurality of guide portions 53 are formed in positions corresponding to the fixing recesses 11 of the plurality of toner containers 10. Since the plurality of guide portions 53 are formed in the same structure, one guide portion 53 will be described in detail below with reference to FIG. 6.

FIG. 6 is a partial perspective view illustrating the guide portion of the guide member of the toner supplying apparatus according to an example.

Referring to FIG. 6, the guide portion 53 includes one pair of vertical walls 53*a* formed in the form of a flat plate to be perpendicular to the lower surface of the guide member 52, and one pair of guide rails 53*b* provided on the one pair of vertical walls 53*a*. The one pair of guide rails 53*b* are formed to be inserted into the one pair of guide recesses 25, 26 of each fixing member 20 and to slide therein.

Lower ends of the one pair of guide rails 53*b* may be connected to each other by a horizontal bar 53*c*. The horizontal bar 53*c* performs a function of a stopper for restricting a descending distance of the fixing member 20. The horizontal bar 53*c* is formed to have the locking projection 29, provided on the rear surface of the body portion 21 of the fixing member 20, locked thereinto. Accordingly, when the fixing member 20 is pressed by the pressing member 50 and is inserted into the fixing recess 11 of the toner container 10, the locking projection 29 of the fixing member 20 is locked by the horizontal bar 53*c* of the guide portion 53.

A fixing protrusion 57 (see FIG. 8) is provided on the lower surface of the guide member 52 between the one pair of vertical walls 53*a* to have one end of the pressing member 50 fixed thereto.

FIG. 7 is a partial view illustrating a state in which the fixing member of the toner supplying apparatus is connected to the guide portion according to an example. FIG. 8 is a partial cross-sectional view illustrating a state in which the fixing member of the toner supplying apparatus is inserted into the fixing recess of the toner container according to an example.

The plurality of pressing members 50 are installed between the guide member 52 and the plurality of fixing members 20 to press down the plurality of fixing members 20. That is, one pressing member 50 is installed on one fixing member 20. One end of the pressing member 50 is fixed to the fixing protrusion 57 of the guide portion 53 of the guide member 52, and the other end is installed in the pressing member receiving portion 22 on the upper surface of the fixing member 20.

The pressing member 50 is formed to apply an elastic force to the fixing member 20. The pressing member 50 may use a coil spring. However, the pressing member 50 is not limited to the coil spring. Various elastic members that can apply an elastic force to the fixing member 20 may be used.

The operating member 30 is provided to slide toward the plurality of toner containers 10, and to operate at least one fixing member 20 among the plurality of fixing members 20 to release the fixing member 20 from the fixing recess 11 of the toner container 10. The operating member 30 is to be moved by the driving device 40.

FIG. 9 is a perspective view illustrating the operating member of the toner supplying apparatus according to an example. FIG. 10 is a cross-sectional view taken on line II-II of the operating member of FIG. 9. FIGS. 11A to 11C are views to illustrate an operation of the fixing member by the operating member of the toner supplying apparatus according to an example. FIG. 12 is a partial cross-sectional view illustrating a state in which the fixing member of the toner supplying apparatus is released from the fixing recess of the toner container according to an example.

Referring to FIG. 9, the operating member 30 is formed of a channel formed in a U shape having a flat bottom, and has a rack gear 31 installed at one end thereof. A front wall 32 and a rear wall 33 of the operating member 30 are spaced apart from each other by a predetermined distance, and are parallel with each other, and the operating member 30 has a plurality of slits 34*a* formed on a bottom surface 34 thereof in a lengthwise direction. The front wall 32 and the rear wall 33 of the operating member 30 are spaced apart from each other by a distance, such that the fixing member 20 can be installed therebetween and can vertically move. In addition, a plurality of guide pins 39 are provided on the front wall 32 and the rear wall 33 of the operating member 30 along the lengthwise direction. In the case of the operating member 30 illustrated in FIG. 3, three guide pins 39 are provided on each of the front wall 32 and the rear wall 33.

The plurality of slits 34*a* provided on the bottom surface 34 of the operating member 30 are formed to correspond to the number of the plurality of fixing members 20. For example, when the number of fixing members 20 are four, four slits 34*a* are provided on the bottom surface 34 of the operating member 30. A length of the slit 34*a* is determined to be longer than a distance by which the operating member 30 slides horizontally.

One pair of operating ribs 37, 38, which face each other and are spaced apart from each other by a predetermined distance, are provided in the operating member 30 to move up and down each of the plurality of fixing members 20. Accordingly, the one pair of operating ribs 37, 38 are provided in plural number to correspond to the plurality of fixing members 20. For example, in the case of the toner supplying apparatus 1 including the four fixing members 20 as in the present example, four pairs of operating ribs 37, 38 are provided. That is, one fixing member 20 is moved up and down by one pair of operating ribs 37, 38.

The one pair of operating ribs 37, 38, that is, the front operating rib 37 and the rear operating rib 38, may be formed on inner surfaces of the front wall 32 and the rear wall 33 of the operating member 30 to support the one pair of guide protrusions 27, 28 of the fixing member 20. That is, the front operating rib 37 is formed on the inner surface of the front wall 32, and the rear operating rib 38 is formed on the inner surface of the rear wall 33. The front operating rib 37 and the rear operating rib 38 are formed in the same shape and are installed to have plane symmetry.

Referring to FIG. 9, the rear operating rib 38 may include a lower end 38*a*, an upper end 38*b*, and an inclined portion 38*c*. The lower end 38*a* is formed of a flat plate having a width enough to support the second guide protrusion 28 of the fixing member 20, and positions the second guide protrusion 28 of the one pair of guide protrusions of the fixing member 20 thereon, such that the insertion portion 23 of the fixing member 20 stays inserted into the fixing recess 11 of the toner container 10.

The upper end 38*b* is formed of a flat plate having a width enough to support the second guide protrusion 28 of the fixing member 20, and positions the second guide protrusion 28 of the fixing member 20 thereon, such that the insertion portion 23 of the fixing member 20 stays released from the fixing recess 11 of the toner container 10. Accordingly, the upper end 38*b* is positioned higher than the lower end 38*a*. The upper end 38*b* and the lower end 38*a* are formed in parallel with each other. A height difference between the upper end 38*b* and the lower end 38*a* may be determined such that, when the guide protrusion 28 of the fixing member 20 is positioned on the lower end 38*a*, the insertion portion 23 of the fixing member 20 is inserted into the fixing recess 11 of the toner container 10, and, when the guide protrusion 28 is positioned on the upper end 38*b*, the insertion portion 23 is released from the fixing recess 11 of the toner container 10.

The upper end 38*b* and the lower end 38*a* are connected with each other by the inclined portion 38*c*. An angle of the inclined portion 38*c* with respect to the lower end 38*a* may be appropriately determined, such that, when the operating member 30 slides, the one pair of guide protrusions 27, 28 of the fixing member 20 smoothly move along the inclined portions 37*c*, 38*c*. For example, the angle of inclination of the inclined portion 37*c*, 38*c* may be determined to range from 30 degrees to 60 degrees.

The rear operating rib 38 may further include separation portions 37*d*, 38*d* to position one pair of guide protrusions 27, 28 of each of the plurality of fixing members 20 thereon, such that all of the insertion portions 23 of the plurality of fixing members 20 stay released from the fixing recesses 11 of the plurality of toner containers 10.

In addition, the rear operating rib 38 may have a stopper 38*e* formed at an end of the separation portion 38*d* to restrict movement of the guide protrusion 28 of the fixing member 20.

The front operating rib 37 may include a lower end 37*a*, an upper end 37*b*, an inclined portion 37*c*, a separation portion 37*d*, and a stopper 37*e* like the above-described rear operating rib 38. The front operating rib 37 is formed the same as the rear operating rib 38, and thus a detailed description thereof is omitted.

Positions and lengths of the lower ends 37*a*, 38*a*, the upper ends 37*b*, 38*b*, and the separation portions 37*d*, 38*d* constituting the plurality of pairs of operating ribs 37, 38 provided on the operating member 30 vary according to positions of the plurality of fixing members 20 fixing the plurality of toner containers 10.

Hereinafter, the positions and lengths of the lower ends 37*a*, 38*a*, the upper ends 37*b*, 38*b*, and the separation portions 37*d*, 38*d* constituting the plurality of pairs of operating ribs 37, 38 will be described in detail with reference to FIG. 10. In the following description, the operating member 30 that is formed to operate four fixing members 20 fixing four toner container 10 will be described by ways of an example. In addition, since the front operating rib 37 and the rear operating rib 38 constituting the one pair of operating ribs 37, 38 are formed in the same shape, the rear operating rib 38 is illustrated in FIG. 10, and will be described. Accordingly, in the following description, the rear operating rib 38 will be referred to as an operating rib.

In FIG. 10, the operating rib which is the closest operating rib to the rack gear 31 is referred to as a first operating rib 38-1, and operating ribs therefrom are referred to as a second operating rib 38-2, a third operating rib 38-3, and a fourth operating rib 38-4 in sequence. Accordingly, the fourth operating rib 38-4 is the farthest operating rib from the rack gear 31.

Referring to FIG. 10, the first operating rib 38-1 moves up and down a first fixing member 20, and includes a lower end 38*a*-1 supporting a guide protrusion 28-1 of the first fixing member 20, an upper end 38*c*-1, a rear lower end 38*g*-1, and a separation portion 38*d*-1.

When the guide protrusion 28-1 is positioned on the lower end 38*a*-1 of the first operating rib 38-1, the insertion portion 23 of the first fixing member 20 stays inserted into the fixing recess 11 of the toner container 10. When the operating member 30 is moved to the left (in the arrow direction of A) by the driving device 40, the guide protrusion 28-1 of the first fixing member 20 positioned on the lower end 38*a*-1 moves along an inclined portion 38*c*-1, and is positioned on the upper end 38*b*-1. When the guide protrusion 28-1 is positioned on the upper end 38*b*-1, the insertion portion 23 of the first fixing member 20 is released in the fixing recess 11 of the toner container 10. Accordingly, when the guide protrusion 28-1 is positioned on the upper end 38*b*-1, the toner container 10 fixed by the first fixing member 20 may be dismounted from the toner container mounting unit 3 of the frame 101.

When the operating member 30 is further moved to the left, the guide protrusion 28-1 moves along a rear inclined surface 38*f*-1 and is positioned on the rear lower end 38*g*-1. When the guide protrusion 28-1 is positioned on the rear lower end 38*g*-1, the insertion portion 23 of the first fixing member 20 is inserted into the fixing recess 11 of the toner container 10.

When the operating member 30 is further moved to the left, the guide protrusion 28-1 moves along a separation inclined surface 38*h*-1 and is positioned on the separation portion 38*d*-1. When the guide protrusion 28-1 is positioned on the separation portion 38*d*-1, the insertion portion 23 of the first fixing member 20 is released from the fixing recess 11 of the toner container 10.

The second operating rib 38-2 and the third operating rib 38-3 move up and down a second fixing member 20 and a third fixing member 20, respectively, and include lower ends 38*a*-2, 38*a*-3 supporting a guide protrusion 28-2 of the second fixing member 20 and a guide protrusion 28-3 of the third fixing member 20, respectively, upper ends 38*b*-2, 38*b*-3, rear lower ends 38*g*-2, 38*g*-3, and separation portions 38*d*-2, 38*d*-3, in the same way as the first operating rib 38-1.

In the same way as the first operating rib 38-1, when the guide protrusion 28-2 of the second fixing member 20 is positioned on the lower end 38*a*-2 and a rear lower end 38*g*-2 of the second operating rib 38-2, the insertion portion 23 of the second fixing member 20 is inserted into the fixing recess 11 of the toner container 10. On the other hand, when the guide protrusion 28-2 of the second fixing member 20 is positioned on the upper end 38*b*-2 and the separation portion 38*d*-2 of the second operating rib 38-2, the insertion portion 23 of the second fixing member 20 is released from the fixing recess 11 of the toner container 10.

In addition, when the guide protrusion 28-3 of the third fixing member 20 is positioned on the lower end 38*a*-3 and a rear lower end 38*g*-3 of the third operating rib 38-3, the insertion portion 23 of the third fixing member 20 is inserted into the fixing recess 11 of the toner container 10. On the other hand, when the guide protrusion 28-3 of the third fixing member 20 is positioned on the upper end 38*b*-3 and the separation portion 38*d*-3 of the third operating rib 38-3, the insertion portion 23 of the third fixing member 20 is released from the fixing recess 11 of the toner container 10.

The fourth operating rib 38-4 includes a lower end 38*a*-4, an inclined portion 38*c*-4, and an upper end 38*b*-4. The fourth operating rib 38-4 does not include a rear lower end unlike the first to third operating ribs 38-1, 38-2, 38-3. When the guide protrusion 28-4 of the fourth fixing member 20 is positioned on the lower end 38*a*-4 of the fourth operating rib 38-4, the insertion portion 23 of the fourth fixing member 20 is inserted into the fixing recess 11 of the toner container 10. On the other hand, when the guide protrusion 28-4 of the fourth fixing member 20 is positioned on the upper end 38*b*-4 of the fourth operating rib 38-4, the insertion portion 23 of the fourth fixing member 20 is released from the fixing recess 11 of the toner container 10.

As described above, when the guide protrusion 28-1 of the first fixing member 20 is positioned on the lower end 38*a*-1 of the first operating rib 38-1, the guide protrusions 28-2, 28-3, 28-4 of the second to fourth fixing members 20 are all positioned on the lower ends 38*a*-2, 38*a*-3, 38*a*-4 of the second to fourth operating ribs 38-2, 38-3, 38-4. Accordingly, since the insertion portions 23 of the first to fourth fixing members 20 are inserted into the fixing recesses 11 of the four toner containers 10, the toner containers 10 cannot be separated from the frame 101.

In this state, when the operating member 30 is moved to the left (in the arrow direction of A) in FIG. 10, and the guide protrusion 28-1 of the first fixing member 20 is positioned on the upper end 38*b*-1 of the first operating rib 38-1, the insertion portion 23 of the first fixing member 20 is released from the fixing recess 11 of the toner container 10. In this case, lengths of the lower ends 38*a*-2, 38*a*-3, 38*a*-4 of the second to fourth operating ribs 38-2, 38-3, 38-4 are determined, such that the guide protrusions 28-2, 28-3, 28-4 of the second to fourth fixing members 20 are moved to the left by the same distance as that of the guide protrusion 28-1 of the first fixing member 20, but are still positioned on the lower ends 38*a*-2, 38*a*-3, 38*a*-4. Accordingly, the length of the lower end 38*a*-1 of the first operating rib 38-1 is shorter than the lengths of the lower ends 38*a*-2, 38*a*-3, 38*a*-4 of the second to fourth fixing members.

In this state, when the operating member 30 is further moved to the left in FIG. 10, and the guide protrusion 28-2 of the second fixing member 20 moves up along the inclined portion 38*c*-2 and is positioned on the upper end 38*b*-2 of the second operating rib 38-2, the insertion portion 23 of the second fixing member 20 is released from the fixing recess 11 of the toner container 10. In this case, the length of the lower end 38*a*-2 of the second operating rib 38-2 is determined, such that the guide protrusion 28-1 of the first fixing member 20 moves down from the upper end 38*b*-1 of the first operating rib 38-1 along the rear inclined portion 38*f*-1, and is positioned on the rear lower end 38*g*-1, and the guide protrusions 28-3, 28-4 of the third and fourth fixing members 20 are positioned on the lower ends 38*a*-3, 38*a*-4 of the third and fourth operating ribs 38-3, 38-4. Accordingly, the length of the lower end 38*a*-2 of the second operating rib 38-2 is longer than the length of the lower end 38*a*-1 of the first operating rib 38-1, and is shorter than the lengths of the lower ends 38*a*-3, 38*a*-4 of the third and fourth operating ribs 38-3, 38-4.

In this state, when the operating member 30 is further moved to the left in FIG. 10, and the guide protrusion 28-3 of the third fixing member 20 moves along the inclined portion 38*c*-3 and is positioned on the upper end 38*b*-3 of the third operating rib 38-3, the insertion portion 23 of the third fixing member 20 is released from the fixing recess 11 of the toner container 10. In this case, the length of the lower end 38*a*-3 of the third operating rib 38-3 is determined, such that the guide protrusion 28-1 of the first fixing member 20 is still positioned on the rear lower end 38*g*-1, the guide protrusion 28-2 of the second fixing member 20 moves down from the upper end 38*b*-2 of the second operating rib 38-2 along the rear inclined portion 38*f*-2, and is positioned on the rear lower end 38*g*-2, and the guide protrusion 28-4 of the fourth fixing member 20 is positioned on the lower end 38*a*-4 of the fourth operating rib 38-4. Accordingly, the length of the lower end 38*a*-3 of the third operating rib 38-2 is longer than the lengths of the lower ends 38*a*-1, 38*a*-2 of the first and second operating ribs 38-1, 38-2, and is shorter than the length of the lower end 38*a*-4 of the fourth operating rib 38-4.

In this state, when the operating member 30 is further moved to the left in FIG. 10, and the guide protrusion 28-4 of the fourth fixing member 20 moves along the inclined portion 38*c*-4 and is positioned on the upper end 38*b*-4 of the fourth operating rib 38-4, the insertion portion 23 of the fourth fixing member 20 is released from the fixing recess 11 of the toner container 10. In this case, the length of the lower end 38*a*-4 of the fourth operating rib 38-4 is determined, such that the guide protrusions 28-1, 28-2 of the first and second fixing members 20 are still positioned on the rear lower ends 38*g*-1, 38*g*-2, and the guide protrusion 28-3 of the third fixing member 20 moves down from the upper end 38*b*-3 of the third operating rib 38-3 along the rear inclined portion 38*f*-3, and is positioned on the rear lower end 38*g*-3. Accordingly, the length of the lower end 38*a*-4 of the fourth operating rib 38-4 is longer than the lengths of the lower ends 38*a*-1, 38*a*-2, 38*a*-3 of the first to third operating ribs 38-1, 38-2, 38-3. Accordingly, the length of the lower end 38*a*-4 of the fourth operating rib 38-4 is the longest length.

The upper end 38*b*-4 of the fourth operating rib 38-4 may be formed to allow the guide protrusion 28-4 of the fourth fixing member 20 to be moved further to the left on the upper end 38*b*-4 of the fourth operating rib 38-4. For example, the upper end 38*b*-4 of the fourth operating rib 38-4 may be formed, such that, when the operating member 10 is further moved to the left in FIG. 10, the guide protrusions 28-1, 28-2, 28-3 of the first to third fixing members 20 move along the separation inclined surfaces 38*h*-1, 38*h*-2, 38*h*-3, and are positioned on the separation portions 38*d*-1, 38*d*-2, 38*d*-3 of the first to third operating ribs 38-1, 38-2, 38-3. In this case, the insertion portions 23 of the first to fourth fixing members 20 are released from the fixing recesses 11 of the corresponding toner containers 10. Accordingly, all of the four toner containers 10 may be separated. Accordingly, the upper end 38*b*-4 of the fourth operating rib 38-4 includes the function of the separation portions 38*d*-1, 38*d*-2, 38*d*-3 of the first to third operating ribs 38-1, 38-2, 38-3. To achieve this, the lengths of the rear lower ends 38*g*-1, 38*g*-2, 38*g*-3 of the first to third operating ribs 38-1, 38-2, 38-3 are determined such that the length of the rear lower end 38*g*-1 of the first operating rib 38-1 is the longest length, and the length of the rear lower end 38*g*-3 of the third operating rib 38-3 is the shortest length.

The operating member 30 having the above-described structure is supported by a guide bracket 60 installed on upper sides of the plurality of toner containers 10 to be slidable in an arrangement direction of the plurality of toner containers 10. The guide bracket 60 is formed of a channel formed in a U shape and having a substantially flat bottom, and is disposed to be perpendicular to the lengthwise direction of the toner container 10. The guide bracket 60 is fixed to the frame 101 to which the plurality of toner containers 10 are fixed, or other portion of the image forming apparatus, and is installed not to be moved even when the operating member 30 operates.

FIG. 13 is a perspective view illustrating the guide bracket of the toner supplying apparatus according to an example.

Referring to FIG. 13, the guide bracket 60 includes a front wall 62, a rear wall 63, and a bottom surface 64. The front wall 62 and the rear wall 63 are spaced apart from each other by a predetermined distance, and lower ends of the front wall 62 and the rear wall 63 are connected with each other by the bottom surface 64. A guide slit 62*a* is provided on the front wall 62 of the guide bracket 60 to guide the plurality of guide pins 39 formed on the front wall 32 of the operating member 30. In addition, a guide slit 63*a* is provided on the rear wall 63 of the guide bracket 60 to guide the plurality of guide pins 39 formed on the rear wall 33 of the operating member 30. A plurality of penetrating holes 64*a* are provided on the bottom surface 64 of the guide bracket 60 to correspond to the plurality of fixing members 20. The fixing members 20 are movable up and down through the penetrating holes 64*a* formed on the bottom surface 64 of the guide bracket 60.

The driving device 40 is for moving the operating member 30, and may include a motor 41 and a power transmitter. The motor 41 is for generating power to move the operating member 30, and may use a motor that can be rotated in both directions. The power transmitter is formed to transmit power of the motor 41 to the operating member 30. The power transmitter may be formed in various structures that can transmit power of the motor 41 to the operating member 30 and allow the operating member 30 to linearly move.

FIG. 14 is a perspective view illustrating the driving device of the toner supplying apparatus according to an example.

Referring to FIG. 14, the driving device 40 of the toner supplying apparatus 1 may include the motor 41, a worm gear 43 installed on a motor shaft 42, the rack gear 31 formed at one end of the operating member 31, and a wheel-pinion 44 installed between the worm gear 43 and the rack gear 31.

The wheel-pinion 44 is installed between the worm gear 43 and the rack gear 31 to be engaged with the worm gear 43 and the rack gear 31, respectively, and transmits rotation of the worm gear 43 to the rack gear 31. The wheel-pinion 44 includes a wheel portion 44*a* engaged with the worm gear 43 installed on the motor 41, and a pinion portion 44*b* engaged with the rack gear 31 installed at the operating member 30. The wheel portion 44*a* and the pinion portion 44*b* are installed on the same axis. Accordingly, when the wheel portion 44*a* is rotated by the worm gear 43, the pinion portion 44*b* is integrally rotated with the wheel portion 44*a*. When the pinion portion 44*b* is rotated, the rack gear 31 provided at the operating member 30 linearly moves. Accordingly, when the motor 41 is rotated, the operating member 30 linearly moves in the guide bracket 60 through the worm gear 43, the wheel-pinon 44, and the rack gear 31.

FIG. 15 is a view illustrating another example of the driving device of the toner supplying apparatus according to an example.

Referring to FIG. 15, the driving device 40' of the toner supplying apparatus may include a motor 41, a driving bevel gear 46 installed on a motor shaft 42, the rack gear 31 provided at one end of the operating member 30, and a bevel-pinion 47 installed between the driving bevel gear 46 and the rack gear 31.

The bevel-pinion 47 is installed between the driving bevel gear 46 and the rack gear 31 to be engaged with the driving bevel gear 46 and the rack gear 31, respectively, and transmits rotation of the driving bevel gear 46 to the rack gear 31. The bevel-pinion 47 includes a bevel gear portion 47*a* engaged with the driving bevel gear 46 installed on the motor 41, and a pinion portion 47*b* engaged with the rack gear 31 installed at the operating member 30. The bevel gear portion 47*a* and the pinion portion 47*b* are installed on the same axis. Accordingly, when the bevel gear portion 47*a* is rotated by the driving bevel gear 46, the pinion portion 47*b* is integrally rotated with the bevel gear portion 47*a*. When the pinion portion 47*b* is rotated, the rack gear 31 provided at the operating member 30 linearly moves. Accordingly, when the motor 41 is rotated, the operating member 30 linearly moves along the guide bracket 60 through the driving bevel gear 46, the bevel-pinon 47, and the rack gear 31.

The driving device 40 is controlled by a controller 190 (see FIG. 22) of the image forming apparatus 100 in which the toner supplying apparatus 1 is installed. The controller 190 may control the driving device 40 based on a signal transmitted from a residual toner detection sensor 160 (see FIG. 22), and selectively operate the plurality of fixing members 20 fixing the plurality of toner containers 10.

Hereinafter, an operation of the toner supplying apparatus according to an example will be described in detail with reference to FIGS. 16A to 16F.

FIGS. 16A to 16F are views to illustrate an operation of the toner supplying apparatus according to an example. For reference, FIGS. 16A to 16F illustrate the four operating ribs 38-1, 38-2, 38-3, 38-4 of the operating member 30, and the guide protrusions 28-1, 28-2, 28-3, 28-4 of the four fixing members 20, in order to explain operations of the four fixing members 20 fixing the four toner containers 10 in the toner supplying apparatus 1 including the four toner containers 10, of individually locking or unlocking the four toner containers 10. In addition, although FIGS. 16A to 16F illustrate the operating member 30 as being fixed, and the four guide protrusions 28-1, 28-2, 28-3, 28-4 as moving in the horizontal direction, this is for convenience of illustration, and actually, the operating member 30 moves in the horizontal direction, and the four guide protrusions 28-1, 28-2, 28-3, 28-4 are fixed in the horizontal direction, and move in the vertical direction by the operating member 30.

FIG. 16A illustrates a state in which the first to fourth toner containers 10 of the toner supplying apparatus 1 are locked by the first to fourth fixing members 20 and cannot be separated. In other words, FIG. 16A illustrates a state in which the insertion portions 23 of the first to fourth fixing members 20 of the toner supplying apparatus 1 are all inserted into the fixing recesses 11 of the first to fourth toner containers 10, and the first to fourth toner containers 10 cannot be dismounted from the toner container mounting units 3. In this case, the guide protrusions 28-1, 28-2, 28-3, 28-4 of the first to fourth fixing members 20 are positioned on the lower ends 38*a*-1, 38*a*-2, 38*a*-3, 38*a*-4 of the first to fourth operating ribs 38-1, 38-2, 38-3, 38-4 of the operating member 30.

In the state of FIG. 16A, when the driving device 40 is driven under control of the controller 190 (see FIG. 22), and the operating member 30 is moved to the left by a predetermined distance, the operating member 30 goes into the state of FIG. 16B.

In the state of FIG. 16B, the first toner container (for example, a black toner container) 10 of the toner supplying apparatus 1 is not locked by the first fixing member 20 and thus is separable, and the second to fourth toner containers 10 are locked by the second to fourth fixing members 20 and thus cannot be separated. In other words, in the state of FIG. 16B, the insertion portion 23 of the first fixing member 20 of the toner supplying apparatus 1 is released from the fixing recess 11 of the first toner container 10, and thus the first toner container 10 can be dismounted from the toner container mounting unit 3, whereas the insertion portions 23 of the second to fourth fixing members 20 are inserted into the fixing recesses 11 of the second to fourth toner containers 10, and thus the second to fourth toner containers 10 cannot be dismounted from the toner container mounting units 3.

For example, when the operating member 30 is moved to the left in the state of FIG. 16A, the guide protrusion 28-1 of the first fixing member 20 moves up along the inclined portion 38*c*-1 of the first operating rib 38-1 and is positioned on the upper end 38*b*-1, and the guide protrusions 28-2, 28-3, 28-4 of the second to fourth fixing members 20 are moved to the left by the same distance as that of the guide protrusion 28-1 of the first fixing member 20, but are still positioned on the lower ends 38*a*-2, 38*a*-3, 38*a*-4 of the second to fourth operating ribs 38-2, 38-3, 38-4 of the operating member 30. When the guide protrusion 28-1 of the first fixing member 20 is positioned on the upper end 38*b*-1 of the first operating rib 38-1, the insertion portion 23 of the first fixing member 20 is released from the fixing recess 11 of the first toner container 10, and thus the first toner container 10 is separable from the toner container mounting unit 3.

In the state of FIG. 16B, when the driving device 40 is driven under control of the controller 190, and moves the operating member 30 to the left by a predetermined distance, the operating member 30 goes into the state of FIG. 16C.

In the state of FIG. 16C, the second toner container (for example, a magenta toner container) 10 of the toner supplying apparatus 1 is not locked by the second fixing member 20 and thus is separable, and the first, third, and fourth toner containers 10 are locked by the first, third, and fourth fixing members 20 and thus cannot be separated. In other words, in the state of FIG. 16C, the insertion portion 23 of the second fixing member 20 of the toner supplying apparatus 1 is released from the fixing recess 11 of the second toner container 10, and thus the second toner container 10 can be dismounted from the toner container mounting unit 3, whereas the insertion portions 23 of the first, third, and fourth fixing members 20 are inserted into the fixing recesses 11 of the first, third, and fourth toner containers 10, and thus the first, third, and fourth toner containers 10 cannot be dismounted from the toner container mounting units 3.

For example, when the operating member 30 is further moved to the left in the state of FIG. 16B, as shown in FIG. 16C, the guide protrusion 28-1 of the first fixing member 20 moves down from the upper end 38*b*-1 of the first operating rib 38-1 along the rear inclined portion 38*f*-1 and is positioned on the rear lower end 38*g*-1, the guide protrusion 28-2 of the second fixing member 20 moves up from the lower end 38*a*-2 of the second operating rib 38-2 along the inclined portion 38*c*-2 and is positioned on the upper end 38*b*-2, and the guide protrusions 28-3, 28-4 of the third and fourth fixing members 20 are moved to the left by the same distance as that of the guide protrusion 28-1 of the first fixing member 20, but are still positioned on the lower ends 38*a*-3, 38*a*-4 of the third and fourth operating ribs 38-3, 38-4 of the operating member 30. When the guide protrusion 28-2 of the second fixing member 20 is positioned on the upper end 38*b*-2 of the second operating rib 38-2, the insertion portion 23 of the second fixing member 20 is released from the fixing recess 11 of the second toner container 10, and thus the second toner container 10 is separable from the toner container mounting unit 3. On the other hand, when the guide protrusion 28-1 of the first fixing member 20 is positioned on the rear lower end 38*g*-1 of the first operating rib 38-1, the insertion portion 23 of the first fixing member 20 is inserted into the fixing recess 11 of the first toner container 10, and thus the first toner container 10 cannot be separated from the toner container mounting unit 3 again.

In the state of FIG. 16B, when the driving device 40 is driven under control of the controller 190, and the operating member 30 is moved to the left by a predetermined distance, the operating member 30 goes into the state of FIG. 16C.

In the state of FIG. 16B, the first toner container (for example, the black toner container) 10 of the toner supplying apparatus 1 is not locked by the first fixing member 20 and thus is separable, and the second to fourth toner containers 10 are locked by the second to fourth fixing members 20 and thus cannot be separated. Specifically, in the state of FIG. 16B, the insertion portion 23 of the first fixing member 20 of the toner supplying apparatus 1 is released from the fixing recess 11 of the first toner container 10, and thus the first toner container 10 can be dismounted from the toner container mounting unit 3, whereas the insertion portions 23 of the second to fourth fixing members 20 are inserted into the fixing recesses 11 of the second to fourth toner containers 10, and thus the second to fourth toner containers 10 cannot be dismounted from the toner container mounting units 3.

When the operating member 30 is moved to the left, the guide protrusion 28-1 of the first fixing member 20 moves up from the lower end 38*a*-1 of the first operating rib 38-1 along the inclined portion 38*c*-1, and is positioned on the upper end 38*b*-1, and the guide protrusions 28-2, 28-3, 28-4 of the second to fourth fixing members 20 are moved to the left by the same distance as that of the guide protrusion 28-1 of the first fixing member 20, but are still positioned on the lower ends 38*a*-2, 38*a*-3, 38*a*-4 of the second to fourth operating ribs 38-2, 38-3, 38-4 of the operating member 30. When the guide protrusion 28-1 of the first fixing member 20 is positioned on the upper end 38*b*-1 of the first operating rib 38-1, the insertion portion 23 of the first fixing member 20 is released from the fixing recess 11 of the first toner container 10, and thus the first toner container 10 is separable from the toner container mounting unit 3.

In the state of FIG. 16B, when the driving device 40 is driven under control of the controller 190, and moves the operating member 30 to the left by a predetermined distance, the operating member 30 goes into the state of FIG. 16C.

In the state of FIG. 16C, the second toner container (for example, the magenta toner container) 10 of the toner supplying apparatus 1 is not locked by the second fixing member 20 and thus is separable, and the first, third, and fourth toner containers 10 are locked by the first, third, and fourth fixing members 20 and thus cannot be separated. In other words, in the state of FIG. 16C, the insertion portion 23 of the second fixing member 20 of the toner supplying apparatus 1 is released from the fixing recess 11 of the second toner container 10, and thus the second toner container 10 can be dismounted from the toner container mounting unit 3, whereas the insertion portions 23 of the first, third, and fourth fixing members 20 are inserted into the fixing recesses 11 of the first, third, and fourth toner containers 10, and thus the first, third, and fourth toner containers 10 cannot be dismounted from the toner container mounting units 3.

For example, when the operating member 30 is further moved to the left in the state of FIG. 16B, as shown in FIG. 16C, the guide protrusion 28-1 of the first fixing member 20 moves down from the upper end 38*b*-1 of the first operating rib 38-1 along the rear inclined portion 38*f*-1 and is positioned on the rear lower end 38*g*-1, the guide protrusion 28-2 of the second fixing member 20 moves up from the lower end 38*a*-2 of the second operating rib 38-2 along the inclined portion 38*c*-2 and is positioned on the upper end 38*b*-2, and the guide protrusions 28-3, 28-4 of the third and fourth fixing members 20 are moved to the left by the same distance as that of the guide protrusion 28-1 of the first fixing member 20, but are still positioned on the lower ends 38*a*-3, 38*a*-4 of the third and fourth operating ribs 38-3, 38-4 of the operating member 30. When the guide protrusion 28-2 of the second fixing member 20 is positioned on the upper end 38*b*-2 of the second operating rib 38-2, the insertion portion 23 of the second fixing member 20 is released from the fixing recess 11 of the second toner container 10, and thus the second toner container 10 is separable from the toner container mounting unit 3. On the other hand, when the guide protrusion 28-1 of the first fixing member 20 is positioned on the rear lower end 38*g*-1 of the first operating rib 38-1, the insertion portion 23 of the first fixing member 20 is inserted into the fixing recess 11 of the first toner container 10, and thus the first toner container 10 cannot be separated from the toner container mounting unit 3 again.

In the state of FIG. 16C, when the driving device 40 is driven under control of the controller 190, and the operating member 30 is moved to the left by a predetermined distance, the operating member 30 goes into the state of FIG. 16D.

In the state of FIG. 16D, the third toner container (for example, a cyan toner container) 10 of the toner supplying apparatus 1 is not locked by the third fixing member 20 and thus is separable, and the first, second, and fourth toner containers 10 are locked by the first, second, and fourth fixing members 20 and thus cannot be separated. In other words, in the state of FIG. 16D, the insertion portion 23 of the third fixing member 20 of the toner supplying apparatus 1 is released from the fixing recess 11 of the third toner container 10, and thus the third toner container 10 can be dismounted from the toner container mounting unit 3, whereas the insertion portions 23 of the first, second, and fourth fixing members 20 are inserted into the fixing recesses 11 of the first, second, and fourth toner containers 10, and thus the first, second, and fourth toner containers 10 cannot be dismounted from the toner container mounting units 3.

For example, when the operating member 30 is further moved to the left by a predetermined distance in the state of FIG. 16C, as shown in FIG. 16D, the guide protrusion 28-1 of the first fixing member 20 moves on the rear lower end 38*g*-1 of the first operating rib 38-1 by a predetermined distance, the guide protrusion 28-2 of the second fixing member 20 moves down from the upper end 38*b*-2 of the second operating rib 38-2 along the rear inclined portion 38*f*-2, and is positioned on the rear lower end 38*g*-2, the guide protrusion 28-3 of the third fixing member 20 moves up from the lower end 38*a*-3 of the third operating rib 38-3 along the inclined portion 38*c*-3, and is positioned on the upper end 38*b*-3, and the guide protrusion 28-4 of the fourth fixing member 20 moves to the left by the same distance as that of the guide protrusion 28-1 of the first fixing member 20, but is positioned on the lower end 38*a*-4 of the fourth operating rib 38-4 of the operating member 30. When the guide protrusion 28-3 of the first fixing member 20 is positioned on the upper end 38*b*-3 of the third operating rib 38-3, the insertion portion 23 of the third fixing member 20 is released from the fixing recess 11 of the third toner container 10, and thus the third toner container 10 is separable from the toner container mounting unit 3. On the other hand, when the guide protrusions 28-1, 28-2 of the first and second fixing members 20 are positioned on the rear lower ends 38*g*-1, 38*g*-2 of the first and second operating ribs 38-1, 38-2, the insertion portions 23 of the first and second fixing members 20 are inserted into the fixing recesses 11 of the first and second toner containers 10, and thus the first and second toner containers 10 cannot be separated from the toner container mounting units 3 again.

In the state of FIG. 16D, when the driving device 40 is driven under control of the controller 190, and the operating member 30 is further moved to the left by a predetermined distance, the operating member 30 goes into the state of FIG. 16E.

In the state of FIG. 16E, the fourth toner container (for example, a yellow toner container) 10 of the toner supplying apparatus 1 is not locked by the fourth fixing member 20 and thus is separable, and the first to third toner containers 10 are locked by the first to third fixing members 20 and thus cannot be separated. In other words, in the state of FIG. 16E, the insertion portion 23 of the fourth fixing member 20 of the toner supplying apparatus 1 is released from the fixing recess 11 of the fourth toner container 10, and thus the fourth toner container 10 can be dismounted from the toner container mounting unit 3, whereas the insertion portions 23 of the first to third fixing members 20 are inserted into the fixing recesses 11 of the first to third toner containers 10, and thus the first to third toner containers 10 cannot be dismounted from the toner container mounting units 3.

For example, when the operating member 30 is further moved to the left by a predetermined distance in the state of FIG. 16D, as shown in FIG. 16E, the guide protrusions 28-1, 28-2 of the first and second fixing member 20 move on the rear lower end 38*g*-1, 38*g*-2 of the first and second operating ribs 38-1, 38-2 by a predetermined distance, the guide protrusion 28-3 of the third fixing member 20 moves down from the upper end 38*b*-3 of the third operating rib 38-2 along the rear inclined portion 38*f*-3, and is positioned on the rear lower end 38*g*-3, and the guide protrusion 28-4 of the fourth fixing member 20 moves up from the lower end 38*a*-4 of the fourth operating rib 38-4 along the inclined portion 38*c*-4, and is positioned on the upper end 38*b*-4. When the guide protrusion 28-4 of the fourth fixing member 20 is positioned on the upper end 38*b*-4 of the fourth operating rib 38-4, the insertion portion 23 of the fourth fixing member 20 is released from the fixing recess 11 of the fourth toner container 10, and thus the fourth toner container 10 is separable from the toner container mounting unit 3. On the other hand, when the guide protrusions 28-1, 28-2, 28-3 of the first to third fixing members 20 are positioned on the rear lower ends 38*g*-1, 38*g*-2, 38*g*-3 of the first to third operating ribs 38-1, 38-2, 38-3, the insertion portions 23 of the first to third fixing members 20 are inserted into the fixing recesses 11 of the first to third toner containers 10, and thus the first to third toner containers 10 cannot be separated from the toner container mounting units 3 again.

In the state of FIG. 16E, when the driving device 40 is driven under control of the controller 190, and the operating member 30 is further moved to the left by a predetermined distance, the operating member 30 goes into the state of FIG. 16F.

FIG. 16F illustrates a state in which all of the first to fourth toner containers 10 of the toner supplying apparatus 1 are not locked by the first to fourth fixing members 20, and are separable. In other words, in the state of FIG. 16F, the insertion portions 23 of the first to fourth fixing members 20 of the toner supplying apparatus 1 are released from the fixing recesses 11 of the first to fourth toner containers 10, and thus all of the first to fourth toner containers 10 can be dismounted from the toner container mounting units 3.

For example, when the operating member 30 is further moved to the left by a predetermined distance in the state of FIG. 16E, as shown in FIG. 16F, the guide protrusions 28-1, 28-2, 28-3 of the first to third fixing members 20 move up from the rear lower ends 38*g*-1, 38*g*-2, 38*g*-3 of the first to third operating ribs 38-1, 38-2, 38-3 along the separation inclined portions 38*h*-1, 38*h*-2, 38*h*-3, and are positioned on the separation portions 38*d*-1, 38*d*-2, 38*d*-3, and the guide protrusion 28-4 of the fourth fixing member 20 moves to the left by a predetermined distance on the upper end 38*b*-4 of the fourth operating rib 38-4 of the operating member 30. When the guide protrusions 28-1, 28-2, 28-3 of the first to third fixing members 20 are positioned on the separation portions 38*d*-1, 38*d*-2, 38*d*-3 of the first to third operating ribs 38-1, 38-2, 38-3, the insertion portions 23 of the first to third fixing members 20 are released from the fixing recesses 11 of the first to third toner containers 10, and thus the first to third toner containers 10 are separable from the toner container mounting units 3. In addition, the guide protrusion 28-4 of the fourth fixing member 20 is still positioned on the upper end 38*b*-4 of the fourth operating rib 38-4, and thus the insertion portion 23 of the fourth fixing member 20 still stays released from the fixing recess 11 of the fourth toner container 10. Accordingly, the fourth toner container 10 is also separable from the toner container mounting unit 3. That is, in the state of FIG. 16F, all of the first to fourth toner containers 10 are separable.

In this state, when the operating member 30 is moved in the opposite direction, that is, to the right, by the driving device 40, the first to fourth toner containers 10 are locked and released in the opposite order of the above-described order.

Specifically, when the operating member 30 is moved to the right by a predetermined distance in the state of FIG. 16F, the operating member 30 goes into the state of FIG. 16E. In this case, the guide protrusions 28-1, 28-2, 28-3 of the first to third fixing members 20 move down from the separation portions 38*d*-1, 38*d*-2, 38*d*-3 of the first to third operating ribs 38-1, 38-2, 38-3 along the separation inclined portions 38*h*-1, 38*h*-2, 38*h*-3, and are positioned on the rear lower ends 38*g*-1, 38*g*-2, 38*g*-3, and the guide protrusion 28-4 of the fourth fixing member 20 moves to the right by a predetermined distance on the upper end 38*b*-4 of the fourth operating rib 38-4 of the operating member 30. Accordingly, the first to third toner containers 10 are locked such that they cannot be dismounted from the toner container mounting units 3, and the fourth toner container 10 is released and can be dismounted from the toner container mounting unit 3.

When the operating member 30 is further moved to the right by a predetermined distance in the state of FIG. 16E, the operating member 30 goes into the state of FIG. 16D. In this case, the guide protrusions 28-1, 28-2 of the first and second fixing members 20 move to the right by a predetermined distance on the rear lower ends 38*g*-1, 38*g*-2 of the first and second operating ribs 38-1, 38-2, the guide protrusion 28-3 of the third fixing member 20 moves up along the rear inclined portion 38*f*-3 of the third operating rib 38-3 and is positioned on the upper end 38*b*-3, and the guide protrusion 28-4 of the fourth fixing member 20 moves down from the upper end 38*b*-4 of the fourth operating rib 38-4 along the inclined portion 38*c*-4, and is positioned on the lower end 38*a*-4. Accordingly, the first, second, and fourth toner containers 10 are locked such that they cannot be dismounted from the toner container mounting units 3, and the third toner container 10 is released and can be dismounted from the toner container mounting unit 3.

Similarly, as the operating member 30 moves to the right, the second toner container 10 and the first toner container 10 are released in sequence, and the other toner containers 10 are locked. When the operating member 30 is moved to the rightmost, the operating member 30 goes into the state of FIG. 16A, and thus all of the first to fourth toner containers 10 are locked and cannot be dismounted form the toner container mounting units 3.

According to the toner supplying apparatus 1 having the above-described structure according to an example, the plurality of toner containers 10 can be released and separated one by one. As another example, the plurality of toner containers 10 can be released and separated all at once when necessary.

Hereinafter, a toner supplying apparatus according to another example will be described with reference to FIGS. 17 to 20.

FIG. 17 is a view illustrating a toner supplying apparatus according to anther example. FIG. 18 is a view illustrating a state in which a support bracket is separated from the toner supplying apparatus of FIG. 17, and FIG. 19 is a view illustrating arrangement of a plurality of fixing members and an operating member in the toner supplying apparatus of FIG. 17. FIG. 20 is a partial perspective view illustrating a fixing recess and a fixing member of a toner container of the toner supplying apparatus of FIG. 17.

Referring to FIGS. 17 to 20, the toner supplying apparatus 200 according to an example may include a plurality of toner containers 210, a plurality of fixing members 220, an operating member 230, and a driving device 240.

In the same way as in the above-described example, the plurality of toner containers 210 may be installed in a plurality of toner container mounting units provided in a frame of the image forming apparatus. The plurality of toner containers 210 are installed to have their respective front surfaces exposed to the outside of the image forming apparatus. As shown in FIG. 1, a door may be provided on the image forming apparatus to cover the entire front surfaces of the plurality of toner containers 210.

Each of the plurality of toner containers 210 may have a fixing recess 211 formed on one side thereof to allow the fixing member 220 to be coupled thereto. The plurality of toner containers 210 are the same as or similar to the plurality of toner containers 210 of the above-described example, except for the positions of the fixing recesses 211, and thus a detailed description thereof is omitted.

The plurality of fixing members 220 may be formed to be selectively coupled to the fixing recesses 211 of the plurality of toner containers 210, respectively. The plurality of fixing members 220 may be provided to correspond to the plurality of toner containers 210 in number. That is, one fixing member 220 is provided for one toner container 210.

As shown in FIGS. 17 and 18, each of the plurality of fixing members 220 is provided on one side of a corresponding toner container 210 to be pivotable by a predetermined angle. The plurality of fixing members 220 are installed to pivot by a predetermined angle by a support bracket 250, which is installed on upper sides of the plurality of toner containers 210 in an arrangement direction of the plurality of toner containers 210. Accordingly, some fixing elements 220 are installed to pivot by a predetermined angle between two adjacent toner containers 210.

The support bracket 250 is formed in a substantially flat plate shape having a narrow width, and has a length to cover all of the plurality of toner containers 210. The support bracket 250 has a plurality of support columns 251, 252, 253, 254 protruding downward from a lower surface thereof to support rotation of the plurality of fixing members 220. Fixing shafts 251*a*, 252*a*, 253*a*, 254*a* are provided on the plurality of support columns 251, 252, 253, 254, respectively, to allow the fixing members 220 to be rotatably installed thereon. In the present example, since the toner supplying apparatus 200 includes four toner containers 210, four support columns 251, 252, 253, 254 are provided on the support bracket 250 to support the rotation of the four fixing members 220.

Since the four fixing members 220 installed on the four support columns 251, 252, 253, 254 are formed the same, hereinafter, one fixing member 220 will be described.

Referring to FIG. 20, the fixing member 220 includes a coupling portion 220*b* formed at one end of the fixing member 220, a release portion 220*c* formed at the other end of the fixing member 220, and a boss portion 220*a* formed between the coupling portion 220*b* and the release portion 220*c*.

The boss portion 220*a* is formed in a substantially disk shape, and has a rotation hole 220*e* formed at the center thereof to allow the fixing shaft 254*a* of the support column 254 to be inserted thereinto. The rotation hole 220*e* of the boss portion 220*a* is formed to ensure smooth rotation about the fixing shaft 254*a* of the support column 254.

The coupling portion 220*b* extends from the outer circumference surface of the boss portion 220*a* in a straight line, and is formed to be coupled to the fixing recess 211 of the toner container 210 by self-weight. Accordingly, the coupling portion 220*b* includes a hook portion 220*d* protruding from one end thereof at about 90 angles. When the hook portion 220*d* is inserted into the fixing recess 211 of the toner container 210, the toner container 210 cannot be dismounted from the toner container mounting unit.

The release portion 220*c* is formed at the other end of the fixing member 220 to allow the fixing member 220 to pivot by a predetermined angle, and selectively interferes with the operating member 230. The release portion 220*c* is provided at the opposite side of the coupling portion 220*b* with reference to the rotation hole 220*e* of the boss portion 220*a*.

When a force is not applied to the fixing member 220 being installed on the fixing shaft 254*a* of the support column 254, the fixing member 220 is maintained perpendicular to the ground. In this case, the hook portion 220*d* of the coupling portion 220*b* of the fixing member 220 is inserted into the fixing recess 211 provided on a side surface of the toner container 210, and the fixing member 220 is coupled to the toner container 210. In this case, since the toner container 210 is influenced by the fixing member 220, the toner container 210 is locked such that it cannot be separated.

The operating member 230 is provided to slide over the plurality of toner containers 210, and operates one of the plurality of fixing members 220 to be released from the fixing recess 211 of the toner container 210. The operating member 230 is provided to be moved by the driving device 240 in the arrangement direction of the plurality of toner containers 210.

The operating member 230 is formed in a bar shape having a substantially rectangular cross section. The operating member 230 has a rack gear 235 provided at one end thereof, and has a plurality of operating pins 231, 232, 233, 234 formed on a front surface of the operating member 230 in the lengthwise direction of the operating member 230 on a straight line to operate the plurality of fixing members 220. The plurality of operating pins 231, 232, 233, 234 are provided to correspond to the release portions 220*c* of the plurality of fixing members 220, respectively. The plurality of operating pins 231, 232, 233, 234 are provided, such that, when one operating pin comes into contact with the release portion 220*c* of the corresponding fixing member 220, the other operating pins do not come into contact with the release portions 220*c* of the other fixing members 220. To achieve this, gaps between the plurality of operating pins 231, 232, 233, 234 are different. For example, a distance between the first operating pin 231 and the second operating pin 232 may be longer than a distance between the second operating pin 232 and the third operating pin 233. In addition, the distance between the second operating pin 232 and the third operating pin 233 may be longer than a distance between the third operating pin 233 and the fourth operating pin 234.

When the operating member 230 is moved, and one of the plurality of operating pins 231, 232, 233, 234 interferes with the release portion 220*c* of the corresponding fixing member 220, the fixing member 220 pivots about the fixing shaft 251*a*, 252*a*, 253*a*, 254*a* of the support column 251, 252, 253, 254 by a predetermined angle in one direction, and the hook portion 220*d* of the fixing member 220 is released from the fixing recess 211 of the toner container 210. When interference between the operating pin 231, 232, 233, 234 of the operating member 230 and the release portion 220*c* of the fixing member 220 is released, the fixing member 220 is rotated about the fixing shaft 251*a*, 252*a*, 253*a*, 254*a* by self weight in the opposite direction, and the hook portion 220*d* of the fixing member 220 is inserted into the fixing recess 31 of the toner container 210.

The rack gear 235 may be formed on the opposite side surface of the plurality of operating pins 231, 232, 233, 234. For example, as shown in FIG. 19, when the plurality of operating pins 231, 232, 233, 234 are formed on the front surface of the operating member 230, the rack gear 235 may be formed on the rear surface of the operating member 230.

The operating member 230 having the above-described structure is supported by a guide bracket 260 installed on the upper sides of the plurality of toner containers 210 to slide in the arrangement direction of the plurality of toner containers 210. The guide bracket 260 is formed of a channel formed in a U shape and having a substantially flat bottom, and is disposed to be perpendicular to the lengthwise direction of the toner container 210. The guide bracket 260 is fixed to the frame to which the plurality of toner containers 210 described above are fixed, or other portion of the image forming apparatus, and is installed not to be moved even when the operating member 230 operates. As another example, the guide bracket 260 may be integrally formed with the above-described support bracket 250.

Referring to FIG. 19, the guide bracket 260 may include a front wall 261, a rear wall 262, and a bottom surface 263. The front wall 261 and the rear wall 262 are spaced apart from each other by a predetermined distance, and lower ends of the front wall 261 and the rear wall 262 are connected with each other by the bottom surface 263. Guide slits 264 are provided on the front wall 261 of the guide bracket 260 to guide the plurality of operating pins 231, 232, 233, 234 formed on the front surface of the operating member 230.

The driving device 240 is for moving the operating member 230, and may include a motor 241 and a power transmitter. The motor 241 is for generating power to move the operating member 230, and may use a motor that can be rotated in both directions. The power transmitter is formed to transmit power of the motor 41 to the operating member 230. The power transmitter may be formed in various structures that can transmit power of the motor 241 to the operating member 230 and allow the operating member 230 to linearly move.

Referring to FIGS. 17 to 19, the driving device 240 of the toner supplying apparatus 200 may include the motor 241, a driving bevel gear 243 installed on a motor shaft 242, the rack gear 235 provided at one end of the operating member 230, and a bevel-pinion 244 installed between the driving bevel gear 243 and the rack gear 235.

The bevel-pinion 244 is installed between the driving bevel gear 243 and the rack gear 235 to be engaged with the driving bevel gear 243 and the rack gear 235, respectively, and transmits rotation of the driving bevel gear 243 to the rack gear 235. The bevel-pinion 244 includes a bevel gear portion 244*a* engaged with the driving bevel gear 243 installed on the motor 241, and a pinion portion 244*b* engaged with the rack gear 31 installed at the operating member 230. The bevel gear portion 244*a* and the pinion portion 244*b* are installed on the same axis. Accordingly, when the bevel gear portion 244*a* is rotated by the driving bevel gear 243, the pinion portion 244*b* is integrally rotated with the bevel gear portion 244*a*. When the pinion portion 244*b* is rotated, the rack gear 235 linearly moves. Accordingly, when the motor 241 is rotated, the operating member 30 linearly moves along the guide bracket 260 through the driving bevel gear 243, the bevel-pinon 244, and the rack gear 235.

The driving device 240 is controlled by a controller 190 (see FIG. 22) of the image forming apparatus 100 in which the toner supplying apparatus 200 is installed. The controller 190 may control the driving device 240 based on a signal transmitted from a residual toner detection sensor 160 (see FIG. 22), and selectively operate the plurality of fixing members 20 fixing the plurality of toner containers 210.

In the present description, the driving device 240 transmits power to the bevel-pinion 244. However, in another example, the driving device 240 may transmit power by using the wheel-pinion 44 as shown in FIG. 14.

Hereinafter, an operation of the toner supplying apparatus according to an example will be described in detail with reference to FIGS. 21A to 21D.

FIGS. 21A to 21D are views to illustrate an operation of the toner supplying apparatus of FIG. 17. For reference, the toner supplying apparatus 200 according to the present example includes four toner containers 210. In the following description, four fixing members 220 selectively fixing the four toner containers 210 are referred to as first to fourth fixing members 221, 222, 223, 224.

A relationship between the plurality of fixing members 221, 222, 223, 224 and the operating member 230 when all of the plurality of toner containers 210 are locked, that is, all of the plurality of toner containers 210 cannot be dismounted from the toner container mounting units, is illustrated in FIG. 18.

As shown in FIG. 18, the hook portions 220*d* of the first to fourth fixing members 221, 222, 223, 224 are inserted into the fixing recesses 211 (see FIG. 20) of the first to fourth toner containers 210. Accordingly, the first to fourth toner containers 210 cannot be separated from the toner container mounting units.

In the state of FIG. 18, when the driving device 240 is driven under control of the controller 190, and the operating member 230 is moved to the left by a predetermined distance, the operating member 230 goes into the state of FIG. 21A.

As shown in FIG. 21A, when the operating member 230 is moved by a predetermined distance, the fourth operating pin 234 interferes with the release portion 224*c* of the fourth fixing member 224 and pivots the fourth fixing member 224 by a predetermined angle in one direction, that is, in a counter clockwise direction. Then, the hook portion 224*d* of the fourth fixing member 224 is released from the fixing recess 211 of the fourth toner container 210, and thus the fourth toner container 210 can be dismounted from the toner container mounting unit. In this case, since the release portions 221*c*, 222*c*, 223*c* of the first to third fixing members 221, 222, 223 are not influenced by the first to third operating pins 231, 232, 233 of the operating member 230, the hook portions 221*d*, 222*d*, 223*d* of the first to third fixing members 221, 222, 223 stay inserted into the fixing recesses 211 of the first to third toner containers 210. Accordingly, the first to third toner containers 210 cannot be dismounted from the toner container mounting units.

In the state of FIG. 21A, when the driving device 240 is driven under control of the controller 190, and the operating member 230 is further moved to the left by a predetermined distance, the operating member 230 goes into the state of FIG. 21B.

As shown in FIG. 21B, when the operating member 230 is moved by a predetermined distance, the fourth operating pin 234 overcomes the release portion 224*c* of the fourth fixing member 224, and the third operating pin 233 interferes with the third fixing member 223 and pivots the third fixing member 223 by a predetermined angle in the counter clockwise direction. Then, the hook portion 223*d* of the third fixing member 223 is released from the fixing recess 211 of the third toner container 210, and thus the third toner container 210 can be dismounted from the toner container mounting unit. In this case, since the fourth fixing member 224 does not interfere with the fourth operating pin 234, the hook portion 224*d* of the fourth fixing member 224 is inserted into the fixing recess 211 of the fourth toner container 210 by self-weight. In addition, since the release portions 220*c* of the first and second fixing members 221, 222 are not influenced by the first and second operating pins 231, 232 of the operating member 230, the hook portions 221*d*, 222*d* of the first and second fixing members 221, 222 stay inserted into the fixing recesses 211 of the first and second toner containers 210. Accordingly, the first, second, and fourth toner containers 210 cannot be dismounted from the toner container mounting units.

In the state of FIG. 21B, when the driving device 240 is driven under control of the controller 190, and the operating member 230 is further moved to the left by a predetermined distance, the operating member 230 goes into the state of FIG. 21C.

As shown in FIG. 21C, when the operating member 230 is moved by a predetermined distance, the third operating pin 233 overcomes the release portion 223*c* of the third fixing member 223, and the second operating pin 232 interferes with the release portion 222*c* of the second fixing member 222 and pivots the second fixing member 222 by a predetermined angle in the counter clockwise direction. Then, the hook portion 222*d* of the second fixing member 222 is released from the fixing recess 211 of the second toner container 210, and thus the second toner container 210 can be dismounted from the toner container mounting unit. In this case, since the release portion 223*c* of the third fixing member 223 does not interfere with the third operating pin 233, the hook portion 223*d* of the third fixing member 223 is inserted into the fixing recess 211 of the third toner container 210 by self-weight. In addition, since the release portions 221*c*, 224*c* of the first and fourth fixing members 221, 224 are not influenced by the first and fourth operating pins 231, 234 of the operating member 230, the hook portions 221*d*, 224*d* of the first and fourth fixing members 221, 224 stay inserted into the fixing recesses 211 of the first and fourth toner containers 210. Accordingly, the first, third, and fourth toner containers 210 cannot be dismounted from the toner container mounting units.

In the state of FIG. 21C, when the driving device 240 is driven under control of the controller 190, and the operating member 230 is further moved to the left by a predetermined distance, the operating member 230 goes into the state of FIG. 21D.

As shown in FIG. 21D, when the operating member 230 is moved by a predetermined distance, the second operating pin 232 overcomes the release portion 222*c* of the second fixing member 222, and the first operating pin 231 interferes with the release portion 221*c* of the first fixing member 221 and pivots the first fixing member 221 by a predetermined angle in the counter clockwise direction. Then, the hook portion 221*d* of the first fixing member 221 is released from the fixing recess 211 of the first toner container 210, and thus the first toner container 210 can be dismounted from the toner container mounting unit. In this case, since the release portion 222*c* of the second fixing member 222 does not interfere with the second operating pin 232, the hook portion 222*d* of the second fixing member 222 is inserted into the fixing recess 211 of the second toner container 210 by self-weight. In addition, since the release portions 223*c*,

224*c* of the third and fourth fixing members 231, 224 are not influenced by the third and fourth operating pins 233, 234 of the operating member 230, the hook portions 223*d*, 224*d* of the third and fourth fixing members 223, 224 stay inserted into the fixing recesses 211 of the third and fourth toner containers 210. Accordingly, the second, third, and fourth toner containers 210 cannot be dismounted from the toner container mounting units.

To lock all of the first to fourth toner containers 210, the operating member 230 is moved in the opposite direction, that is, to the right in FIG. 21, by a predetermined distance, and is made go into the state of FIG. 18. In this case, since the first to fourth operating pins 231, 232, 233, 234 of the operating member 230 do not interfere with the release portions 221*c*, 222*c*, 223*c*, 224*c* of the first to fourth fixing members 221, 222, 223, 224, the hook portions 221*d*, 222*d*, 223*d*, 224*d* of the first to fourth fixing members 221, 222, 223, 224 are inserted into the fixing recess 211 of the first to fourth toner containers 210. Accordingly, all of the first to fourth toner containers 210 cannot be dismounted from the toner container mounting units.

Hereinafter, the image forming apparatus 100 provided with the toner supplying apparatus 1, 200 having the above-described configuration will be described with reference to FIG. 22.

FIG. 22 is a function block diagram illustrating an image forming apparatus including a toner supplying apparatus according to an example.

Referring to FIG. 22, the image forming apparatus 100 according to an example may include the toner supplying apparatus 1, a paper feeder 110, an image former 120, a fuser 130, a paper discharger 140, an inputter and outputter 150, a residual toner detection sensor 160, and a controller 190.

The toner supplying apparatus 1 includes a plurality of toner containers 10 (see FIG. 1), and supplies toner to the image former 120 under control of the controller 190.

The paper feeder 110 stores predetermined printing media and supplies printing media to the image former 120 sheet by sheet.

The image former 120 forms an electrostatic latent image corresponding to printing data on an image carrier, and develops the electrostatic latent image into a toner image by using toner supplied from the toner supplying apparatus 1. In this case, toner stored in the plurality of toner containers 10 of the toner supplying apparatus 1 is supplied to the image former 120, and thus is consumed.

The toner image formed on the image carrier of the image former 120 is transferred to a printing medium supplied by the paper feeder 110 by a transfer member.

The fuser 130 fuses the toner image transferred to the printing medium by the image former 120 onto the printing medium by applying predetermined heat and pressure.

The paper discharger 140 discharges the printing medium having the image fused thereonto to the outside of the image forming apparatus 100.

The inputter and outputter 150 may include an input unit having a plurality of buttons or a touch screen formed thereon to allow a user to input a command, and a display informing a printing state to the outside.

The residual toner detection sensor 160 detects an amount of toner stored in the plurality of toner containers 10 of the toner supplying apparatus 1, and transmits the detected amount of toner to the controller 190.

The controller 190 is to control the toner supplying apparatus 1, the paper feeder 110, the image former 120, the fuser 130, and the paper discharger 140 to perform printing. In addition, the controller 190 may identify an amount of toner remaining in the plurality of toner containers 10 based on a signal received from the residual toner detection sensor 160.

When toner of any one of the plurality of toner containers 10 is completely consumed, the controller 190 may control the driving device 40 of the toner supplying apparatus 1 to unlock the fixing member 20 fixing the toner container 10 having no toner. In this case, the controller 190 unlocks the toner container 10 having no toner, and maintains the other toner containers 10 having toner in the locking state. In addition, the controller 190 informs a user that the toner container 10 has no toner through the inputter and outputter 150, such that the user can replace the toner container 10.

When the replacement of the toner container 10 is completed, the controller 190 normally performs printing.

The toner supplying apparatus according to an example described above unlocks the toner container having no toner, and maintains the other toner containers having toner in the locking state. Therefore, the user can be prevented from replacing the toner container having toner.

In addition, according the toner supplying apparatus according to an example, since the plurality of toner containers are individually controlled to be locked and unlocked by one driving source, a structure may be simple and a manufacturing cost may be reduced.

While the disclosure has been shown and described with reference to certain examples thereof, it will be understood by those skilled in the art that various changes in form and details may be made therein without departing from the spirit and scope of the disclosure as defined by the appended claims. Therefore, the scope of the disclosure is defined not by the detailed description of the disclosure but by the appended claims, and all differences within the scope will be construed as being included in the present disclosure.

The invention claimed is:

1. A toner supplying apparatus comprising:

a plurality of toner containers, each of the plurality of toner containers including a fixing recess;

a plurality of fixing members to be selectively coupled to the fixing recesses, each of the plurality of fixing members including a hook portion to be inserted into each, respective fixing recess of the plurality of toner containers;

an operating member to slide with respect to the plurality of toner containers, and to operate at least one of the plurality of fixing members to separate the operated fixing members from the coupled fixing recess; and a driving device to move the operating member.

2. The toner supplying apparatus of claim 1, wherein the operating member is supported by a guide bracket, the guide bracket being installed on the upper sides of the plurality of toner containers to slide in a direction of the plurality of toner containers.

3. The toner supplying apparatus of claim 1, wherein each of the plurality of fixing members is provided at one side of the corresponding toner container to pivot by a predetermined angle.

4. The toner supplying apparatus of claim 3, wherein each of the plurality of fixing members comprises:

a coupling portion formed at a first end of the fixing member, the coupling portion being coupled to the fixing recess of the toner container by self-weight;

a release portion formed at a second end of the fixing member, the release portion being provided to selectively interfere with the operating member; and a boss portion formed between the coupling portion and the release portion, the boss portion being installed to be pivotable about a fixing shaft.

5. The toner supplying apparatus of claim 4, wherein the operating member comprises a plurality of operating pins corresponding to the respective release portions of the plurality of fixing members, wherein, when one operating pin among the plurality of operating pins interferes with the release portion of the corresponding fixing member, the coupling portion of the fixing member is released from the fixing recess of the toner container, and wherein, when the interference between the release portion of the fixing member and the operating pin of the operating member is released, the coupling portion of the fixing member is inserted into the fixing recess of the toner container by self-weight.

6. The toner supplying apparatus of claim 3, wherein the plurality of fixing members are pivotably supported by a plurality of support columns provided on one side of the plurality of toner containers.

7. An image forming apparatus comprising:

a plurality of image formers;

the toner supplying apparatus of claim 1, to supply toner to the plurality of image formers;

a residual toner detection sensor to detect an amount of toner remaining in the plurality of toner containers of the toner supplying apparatus; and a controller to control the driving device of the toner supplying apparatus according to a signal of the residual toner detection sensor, wherein, when it is determined that one toner container of the plurality of toner containers has no toner based on the signal from the residual toner detection sensor, the controller controls the driving device of the toner supplying apparatus to unlock the fixing member corresponding to the toner container having no toner to be released from the fixing recess of the toner container.

8. A toner supplying apparatus comprising:

a plurality of toner containers, each of the plurality of toner containers including a fixing recess;

a plurality of fixing members to be selectively coupled to the fixing recesses;

an operating member to slide with respect to the plurality of toner containers, and to operate at least one of the plurality of fixing members to separate the operated fixing members from the coupled fixing recess; and a driving device to move the operating member, wherein the plurality of fixing members are installed on upper sides of the plurality of toner containers, and the plurality of fixing members are to move up and down.

9. The toner supplying apparatus of claim 8, further comprising:

a plurality of pressing members to press downward on the plurality of fixing members, respectively; and a guide member provided with a plurality of guide portions to guide upward and downward movements of the plurality of fixing members.

10. The toner supplying apparatus of claim 9, wherein each of the plurality of fixing members comprises:

an insertion portion to be inserted into the fixing recess of the toner container;

a body portion, the insertion portion extending perpendicularly from the body portion, and the body portion being brought into contact with one end of a corresponding pressing member among the plurality of pressing members;

a pair of guide recesses formed on both side surfaces of the body portion, and guided by a corresponding guide portion among the plurality of guide portions; and a pair of guide protrusions formed on a front surface and a rear surface of the body portion, respectively, the pair of guide protrusions and the body portion being collinear.

11. The toner supplying apparatus of claim 10, wherein the operating member comprises a pair of operating ribs, the operating ribs face each other and are spaced apart from each other by a predetermined distance, and the operating member is to guide the pair of guide protrusions of each of the plurality of fixing members to move up the fixing member.

12. The toner supplying apparatus of claim 11, wherein the plurality of toner containers comprise four toner containers, and wherein the pair of operating ribs are to move up fixing members corresponding to three toner containers of the four toner containers, simultaneously.

13. A toner supplying apparatus comprising:

a plurality of toner containers, each of the plurality of toner containers including a fixing recess;

a plurality of fixing members to be selectively coupled to the fixing recesses;

an operating member to slide with respect to the plurality of toner containers, and to operate at least one of the plurality of fixing members to separate the operated fixing members from the coupled fixing recess; and a driving device to move the operating member, wherein the driving device comprises:

a motor; and a power transmitter to transmit power of the motor to the operating member.

14. The toner supplying apparatus of claim 13, wherein the power transmitter comprises:

a worm gear installed on a rotation shaft of the motor;

a rack gear provided at one end of the operating member; and a wheel-pinion installed between the worm gear and the rack gear to be engaged with the worm gear and the rack gear, the wheel-pinion is to be rotated by rotation of the worm gear.

15. The toner supplying apparatus of claim 13, wherein the power transmitter comprises:

a bevel gear installed on a rotation shaft of the motor;

a rack gear provided at one end of the operating member; and a bevel-pinion installed between the bevel gear and the rack gear to be engaged with the bevel gear and the rack gear, the bevel-pinion is to be rotated by rotation of the bevel gear.

* * * * *